US007943841B2

(12) United States Patent
Toda

(10) Patent No.: US 7,943,841 B2
(45) Date of Patent: May 17, 2011

(54) HIGH-HAT TYPE ELECTRONIC PAD

(75) Inventor: Jiro Toda, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 69 days.

(21) Appl. No.: 12/324,575

(22) Filed: Nov. 26, 2008

(65) Prior Publication Data

US 2009/0139387 A1 Jun. 4, 2009

(30) Foreign Application Priority Data

Nov. 27, 2007 (JP) ..... 2007-306140
Nov. 27, 2007 (JP) ..... 2007-306141
Nov. 27, 2007 (JP) ..... 2007-306142
Nov. 27, 2007 (JP) ..... 2007-306143

(51) Int. Cl.
*G10D 13/02* (2006.01)

(52) U.S. Cl. ..... 84/422.3; 84/104; 84/411 R; 84/422.1; 84/422.2

(58) Field of Classification Search ..... None
See application file for complete search history.

(56) References Cited

U.S. PATENT DOCUMENTS 6,815,604 B2 * 11/2004 Toda ..... 84/746
7,294,778 B2 * 11/2007 Susami ..... 84/723
7,468,483 B2 * 12/2008 Yoshino ..... 84/723
7,473,834 B2 * 1/2009 Yoshino ..... 84/402
7,560,638 B2 * 7/2009 Susami ..... 84/723
2003/0200860 A1 * 10/2003 Toda ..... 84/746
2005/0145101 A1 * 7/2005 Yoshino ..... 84/723
2005/0145102 A1 * 7/2005 Susami ..... 84/735

FOREIGN PATENT DOCUMENTS

JP 60-217394 10/1985
JP 06-011000 2/1994
JP 2003-316355 11/2003

* cited by examiner

*Primary Examiner* — Marlon T Fletcher

(74) *Attorney, Agent, or Firm* — Morrison & Foerster LLP

(57) ABSTRACT

A hi-hat type electronic pad capable of detecting, with reality, an up-and-down motion of a movable pad body that operates similarly to a top cymbal of an acoustic hi-hat, and capable of accurately detecting the operation by one of operation switches which is depressed by a corresponding actuator, even if the movable pad body is moved downward in an inclined state. An operation detecting unit includes a base plate and an elastic member and is provided on an HH pad body. When the HH pad body is moved downward by a pedal operation, the actuators formed on an upper surface of the elastic member and corresponding sheet switches disposed on the base plate are made in contact with one another, whereby operation ON is detected. The sheet switches are formed into an annular shape as viewed in plan.

8 Claims, 11 Drawing Sheets

HIGH-HAT TYPE ELECTRONIC PAD

BACKGROUND OF THE INVENTION

1. Field of the Invention

The present invention relates to a hi-hat type electronic pad suitable for an electronic percussion instrument.

2. Description of the Related Art

An acoustic hi-hat (abbreviated as HH) cymbal is adapted to generate a musical tone when a top cymbal is struck with a stick and also when the top cymbal is struck with a pedal, i.e., when moved up and down by a pedal operation so as to be in contact with a bottom cymbal.

Conventionally, there is known an electronic percussion instrument adapted to detect a pedal operation and output a detection signal for musical tone control in response to the pedal operation.

For example, Japanese Laid-open Patent Publication No. 2003-316355 discloses an electronic percussion instrument having a sensor for detecting an amount of pedal depression, and adapted to control the tone color of an electronic sound in response to the pedal operation. The sensor is comprised of a plate mounted to a movable shaft extending through a hi-hat part of the instrument and a switch provided in the hi-hat part for being depressed by the plate. The hi-hat part as fake cymbals is fixed to a stand of the instrument.

Japanese Laid-open Utility Model Publication No. 6-11000 discloses an electronic percussion instrument in which a movable shaft extending through the center of a hi-hat part is moved down by a pedal operation to turn on a sensor disposed to face a lower end of the movable shaft. The hi-hat part per se is not movable up and down.

Japanese Laid-open Patent Publication No. 60-217394 discloses an electronic hi-hat cymbal having a movable arm adapted to be moved up and down by a pedal operation. First and second switches attached to a cymbal part are turned on in sequence by the movable arm in response to pedal depression. The cymbal part per se, which is attached to a stand, is not movable up and down.

In the arrangements disclosed in the above-described patent publications, a pad (cymbal part) or the like corresponding to a top cymbal is not movable up and down, and the appearance of operation at the time of being struck with a pedal quite differs from that in an acoustic HH cymbal. A relation between the appearance of motion of the pedal-operated part and an actually generated musical tone also differs from that in the acoustic HH cymbal, which may bring discomfort to the player.

If the pad corresponding to a top cymbal is actually moved up and down in conjunction with a pedal operation and such action is detected as in the case of an acoustic HH cymbal, the pedal operation can be possibly detected with reality (similarly to in the case of an acoustic HH cymbal). However, the top cymbal is pivoted when struck, and therefore, the top cymbal is not always maintained in a horizontal state when moved downward by a pedal operation. To accurately detect upward and downward movements of the pad corresponding to the top cymbal, therefore, the inclination of the pad due to the pivotal motion must be taken into consideration.

In the acoustic HH cymbal, a reaction force is necessarily produced when the top cymbal is made in contact with the bottom cymbal by the pedal operation. With further depression of the pedal, each cymbal is slightly deformed so as to be turned inside out, and the resultant change in reaction force is perceived by the player. Therefore, the player can depress the pedal with appropriate strength, while perceiving the change in reaction force.

In the arrangements disclosed in the above described patent publications, a change in reaction force perceived by the foot at the time of pedal operation is not taken into consideration, and it is therefore difficult for the player to grasp how strong the pedal is to be depressed, which poses a problem that a realistic feeling of pedal operation cannot be attained.

The electronic instrument disclosed in Japanese Laid-open Patent Publication No. 2003-316355 includes a sensor for detecting striking to a hi-hat part in addition to the sensor for detecting a pedal operation. Thus, two sets of wirings and signal output units each for outputting a signal to the outside such as a controller of the instrument are separately disposed at two places. This results in a complicated structure and an increased number of component parts, and the wirings are complicated and liable to catch something, thus posing a problem that the wirings and output terminals are difficult to handle and manage.

SUMMARY OF THE INVENTION

The present invention provides a hi-hat type electronic pad capable of detecting a realistic up-and-down motion of a movable pad body, which operates similarly to a top cymbal of an acoustic HH, and also capable of accurately detecting a downward motion of the movable pad body even when it is moved downward in an inclined state.

The present invention provides a hi-hat type electronic pad capable of detecting a realistic up-and-down motion of a movable pad body, which operates similarly to a top cymbal of an acoustic HH, and also capable of accurately detecting a downward motion of the movable pad body by correcting the posture of the movable pad body in a case that it is moved downward in an inclined state.

The present invention provides a hi-hat type electronic pad capable of realizing a pedal operation feeling with less discomfort to the player by having a movable pad body to be moved up and down similarly to a top cymbal of an acoustic HH and by generating a change in reaction force against a pedal operation similarly to in the case of an acoustic HH.

The present invention also provides a hi-hat type electronic pad capable of realistically detecting striking with a stick and striking with a pedal to a movable pad body that operates similarly to a top cymbal of an acoustic HH, and capable of aggregating to the side of movable pad body, for ease of management, external output units and wirings associated with signal output at the time of detection of striking.

According to a first aspect of the present invention, there is provided a hi-hat type electronic pad comprising a movable pad body formed into a circular shape as viewed in plan and adapted to be supported by a support member so as to be pivoted when it is struck and adapted to be vertically moved in unison with the support member vertically moved by a pedal operation, a bottom section configured separately from the movable pad body and disposed beneath the movable pad body, the bottom section having a fixed vertical position, and an operation detecting unit disposed at that part of one of the movable pad body and the bottom section which faces another of the movable pad body and the bottom section, wherein when the movable pad body is moved downward, the operation detecting unit is adapted to be in contact with another of the movable pad body and the bottom section, the operation detecting unit includes an actuator and an operation sensor, the actuator being disposed to project from a base corresponding to the part of one of the movable pad body and the bottom section facing another of the movable pad body and the bottom section in a direction vertically away from another of the movable pad body and the bottom section, the operation sensor being planarity disposed on a sensor installation surface facing the actuator, the base being adapted to be movable toward and away from the sensor installation surface, the operation sensor is adapted to output a detection signal when depressed by the actuator due to the operation detecting unit being in contact with another of the movable pad body and the bottom section, and the operation sensor is formed into a substantially annular shape as viewed in plan.

With the hi-hat type electronic pad according to the first aspect of this invention, a realistic up-and-down motion of a movable pad body, which operates similarly to a top cymbal of an acoustic HH, can be detected, and even if the movable pad body is moved downward in an inclined state, the downward motion can be accurately detected by the operation sensor depressed by the actuator.

A plurality of the operation sensors can be provided coaxially at different radial positions, and a plurality of the actuators can be provided to correspond to respective ones of the plurality of the operation sensors, the plurality of the operation sensor cooperating with the plurality of the actuators to make up a plurality of groups each including at least one of the operation sensors and a corresponding at least one of the actuators, a distance between the operation sensor and the actuator of a more radially outward group in a state that the operation detecting unit is not in contact with another of the movable pad body and the bottom section can be made smaller, and detection signals can be output from the operation sensors in an order from the operation sensor of a radially outwardmost group to the operation sensor of a radially inwardmost group when the operation detecting unit is in contact with another of the movable pad body and the bottom section.

In this case, a more realistic motion can be detected by the stepwise detection.

The operation sensors of at least radially inwardmost group can be intermittently installed in a circumferential direction, and the operation sensor in a radially more outward group can be installed in a broader circumferential installation range and formed into a shape closer to an annular shape.

In this case, the operation detection at an initial stage of contact is ensured by the radially outward operation sensor which is broad in installation range, and the radially inward operation sensor for detecting the operation in a latter stage of contact in which the inclination of the movable pad body becomes smaller is installed over a minimum range, whereby the construction can be simplified and the cost can be reduced.

The actuators can be disposed as viewed in plan at two or more places which are most distant from one another on circumferences of circles that correspond to respective ones of corresponding operation sensors.

In this case, the downward motion can be detected with accuracy, even if the movable pad body is moved downward in a state inclined in any direction.

According to a second aspect of the present invention, there is provided a hi-hat type electronic pad comprising a movable pad body formed into a circular shape as viewed in plan and adapted to be supported by a support member so as to be pivoted when it is struck and adapted to be vertically moved in unison with the support member vertically moved by a pedal operation, a bottom section configured separately from the movable pad body and disposed beneath the movable pad body, the bottom section having a fixed vertical position, and an operation detecting unit disposed at that part of one of the movable pad body and the bottom section which faces another of the movable pad body and the bottom section, wherein when the movable pad body is moved downward, the operation detecting unit is adapted to be depressed onto a flat contact surface of another of the movable pad body and the bottom section, and output a detection signal, and the contact surface of another of the movable pad body and the bottom section is formed by a sliding member on which the operation detecting unit is smoothly slid.

With the hi-hat type electronic pad according to the second aspect of this invention, a realistic up-and-down motion of a movable pad body, which operates similarly to a top cymbal of an acoustic HH, can be detected, and a downward motion of the movable pad body even in an inclined state can be accurately detected by correcting the posture of the movable pad body by a smooth sliding contact at contact surfaces.

According to a third aspect of the present invention, there is provided a hi-hat type electronic pad having a movable pad body formed into a circular shape as viewed in plan and adapted to be supported by a support member so as to be pivoted when it is struck and to be vertically moved in unison with the support member vertically moved by a pedal operation, a bottom section configured separately from the movable pad body and disposed beneath the movable pad body, the bottom section having a fixed vertical position, the movable pad body being adapted to be in contact with the bottom section in a forward stroke of the pedal operation in which the movable pad body is moved downward, the hi-hat type electronic pad comprising a first elastic member provided in either one of the movable pad body and the bottom section, and adapted to be elastically deformed when the movable pad body is in contact with the bottom section in the forward stroke of the pedal operation, and a second elastic member disposed in another of the movable pad body and the bottom section and having rigidity higher than that of the first elastic member, the second elastic member being adapted to be macroscopically elastically deformed after the first elastic member is elastically deformed by a predetermined amount in the forward stroke of the pedal operation, wherein a reaction force, including a first reaction force generated by elastic deformation of the first elastic member and a second reaction force generated by elastic deformation of the second elastic member, is generated in at least two stages in the forward stroke of the pedal operation.

With the hi-hat type electronic pad according to the third aspect of this invention, a pedal operation feeling with less discomfort to the player can be realized by having the movable pad body that moves up and down similarly to a top cymbal of an acoustic HH and by generating a change in reaction force, similar to that in an acoustic HH, against the pedal operation.

The first elastic member can be disposed in that part of one of the movable pad body and the bottom section facing another of the movable pad body and the bottom section, and a detection signal can be output when the first elastic member is depressed by another of the movable pad body and the bottom section in the forward stroke of the pedal operation.

In this case, the first elastic member additionally has a function of detecting the operation of the movable pad body, and therefore, the up-and-down motion of the movable pad body can be detected with a compact design and with reality.

An operation of the movable pad body can be detected in plural stages in the forward stroke of the pedal operation and an operation up to a predetermined stage can be detected when the first elastic member is elastically deformed by the predetermined amount.

In this case, the timing of the operation at the predetermined stage can be made coincident with the start timing of generation of the second reaction force, whereby a more realistic feeling of pedal operation can be realized.

The second elastic member can be provided in that part of a lower portion of the bottom section which is supported by a fixed part which is fixed relative to an installation surface.

In this case, the bottom section is liable to be attached by elasticity to the fixed part, which is fixed relative to the installation surface, so as not to be taken away by the movable pad body when a pedal-off operation is performed. As a result, the bottom section can be supported such as simply by being placed, without the need of being fixed.

According to a fourth aspect of the present invention, there is provided a hi-hat type electronic pad having a movable pad body formed into a circular shape as viewed in plan and adapted to be supported by a support member so as to be pivoted when it is struck and to be vertically moved in unison with the support member vertically moved by a pedal operation, and a bottom section configured separately from the movable pad body and disposed beneath the movable pad body, the bottom section having a fixed vertical position, the hi-hat type electronic pad comprising a striking detection unit disposed on the movable pad body and adapted to output a detection signal when detecting that the movable pad body is struck, an operation detecting unit disposed in that part of the movable pad body facing the bottom section and adapted to output a detection signal when depressed by the bottom section as the movable pad body is moved downward, and an external output unit disposed on the movable pad body and adapted to output the detection signal of the striking detection unit and the detection signal of the operation detecting unit to outside.

With the fourth aspect of this invention, striking with a stick and striking with a pedal to the movable pad body that operates similarly to a top cymbal of an acoustic HH can be realistically detected, and external output units and wirings associated with signal output can be aggregated to the side of the movable pad body for ease of management.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1:
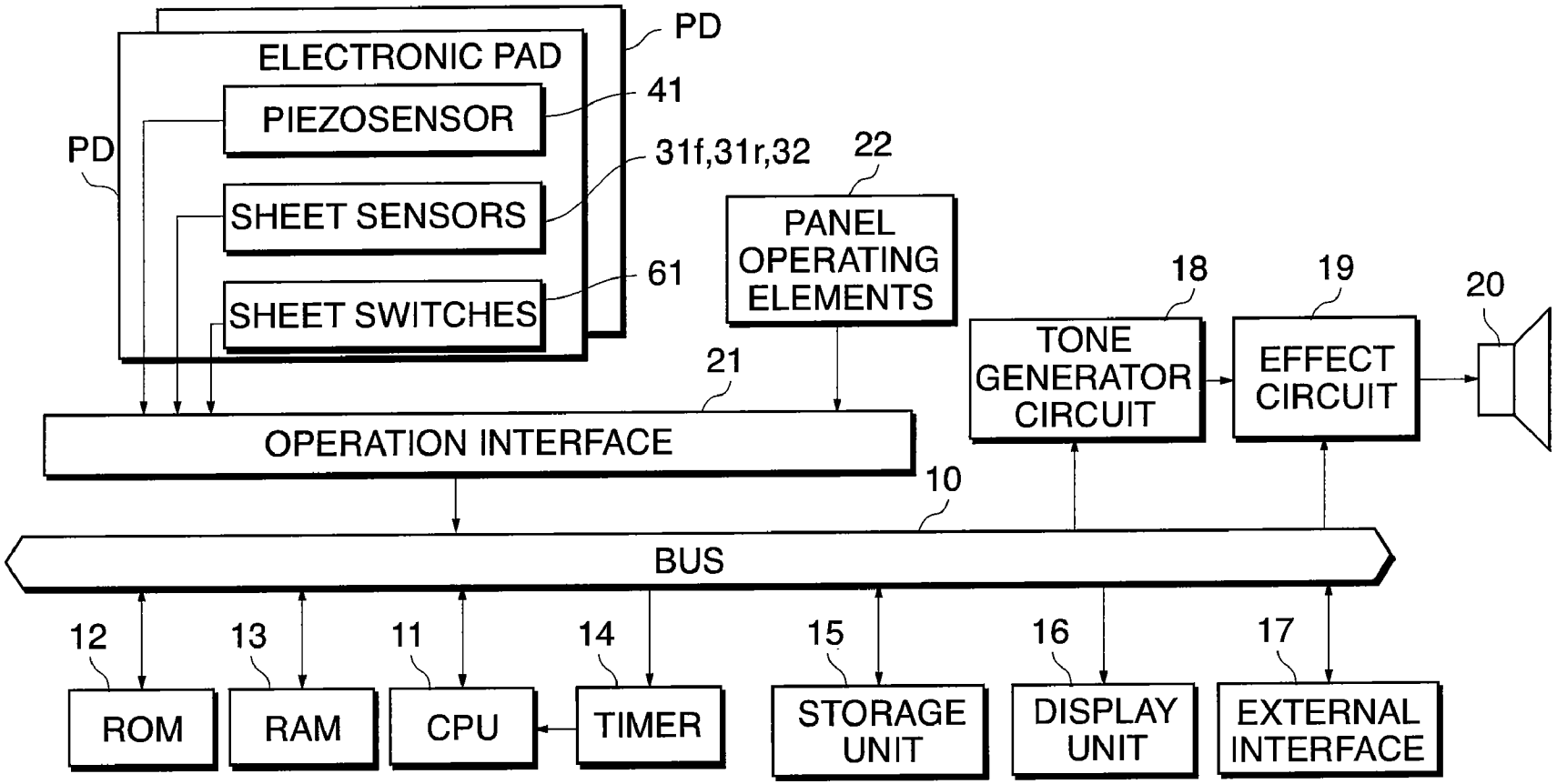
FIG. 1 is a block diagram showing the entire construction of an electronic percussion instrument including electronic pads according to one embodiment of this invention.

FIG. 1 shows in block diagram the entire construction of an electronic percussion instrument including an electronic pad according to one embodiment of this invention. This electronic percussion instrument includes a plurality of electronic pads PD adapted to be struck. Each electronic pad PD is of a hi-hat (abbreviated as "HH") type, which is an alternative to a hi-hat cymbal.

The electronic percussion instrument includes a ROM 12, a RAM 13, a timer 14, a storage unit 15, a display unit 16, an external interface 17, an operation interface 21, a tone generator circuit 18, and an effect circuit 19, which are connected via a bus 10 to a CPU 11.

Panel operating elements 22, which are connected to the operation interface 21, are for inputting various information. For example, what musical tone is to be produced in what tone color can be set based on a detection signal of each respective electronic pad PD. The electronic pad PD includes a piezosensor 41 described below, a plurality of sheet sensors 31 (31*f* and 31*r*) and 37, and sheet switches 61. Detection signals by these sensors and the switches are supplied via the operation interface 21 to the CPU 11.

The display unit 16 is constituted by a liquid crystal display (LCD) or the like and is adapted to display various information such as musical score and characters. The timer 14 is connected to the CPU 11. The external interface 17 includes various interfaces such as a MIDI interface and a LAN (local area network). A sound system 20 is connected to the effect circuit 19.

The CPU 11 controls the entire electronic percussion instrument. The ROM 12 stores a control program implemented by the CPU 11, various table data, and the like. The RAM 13 temporarily stores various input information such as performance data and text data, various flags, buffer data, and computation results. The timer 14 measures an interrupt time in time interruption processing and various times. The storage unit 15 stores various application programs including the control program, various music data, various data, and the like.

The external interface 17 transmits and receives MIDI (musical instrument digital interface) signals and various data to and from external equipment. The tone generator circuit 18 converts performance data based on detection signals input from the electronic pads PD and performance data set in advance into musical tone signals. The effect circuit 19 adds various effects to musical signals input from the tone generator circuit 18. The sound system 20 includes a DAC (digital-to-analog converter), an amplifier, a speaker, etc., and converts musical signals input from the effect circuit 19, etc. into acoustic sounds.

Figure 2:
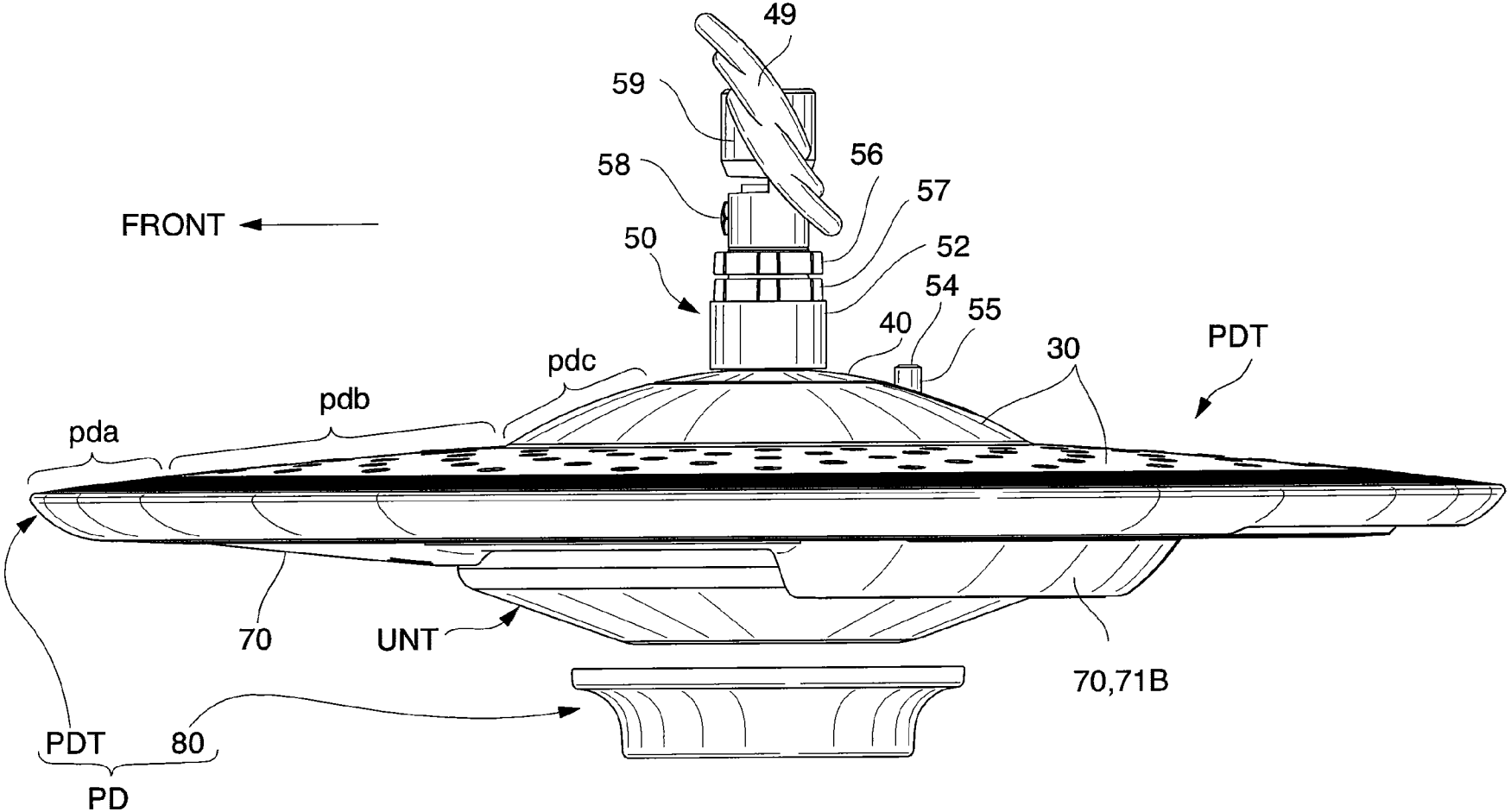
FIG. 2 is a right side view of one of the hi-hat type electronic pads.

FIG. 2 shows in right side view one of the hi-hat type electronic pads PD. In the following, the side of the horizontally supported electronic pad PD toward the player will be referred to as the front side, and the left and right directions are determined in reference to the player. Each of the electronic pads PD is comprised of an HH pad body PDT and a bottom seat 80, each of which is formed into a circular shape as viewed in plan. The HH pad body PDT and the bottom seat 80 respectively correspond to a top cymbal and a bottom cymbal of an acoustic hi-hat cymbal.

Figure 3:
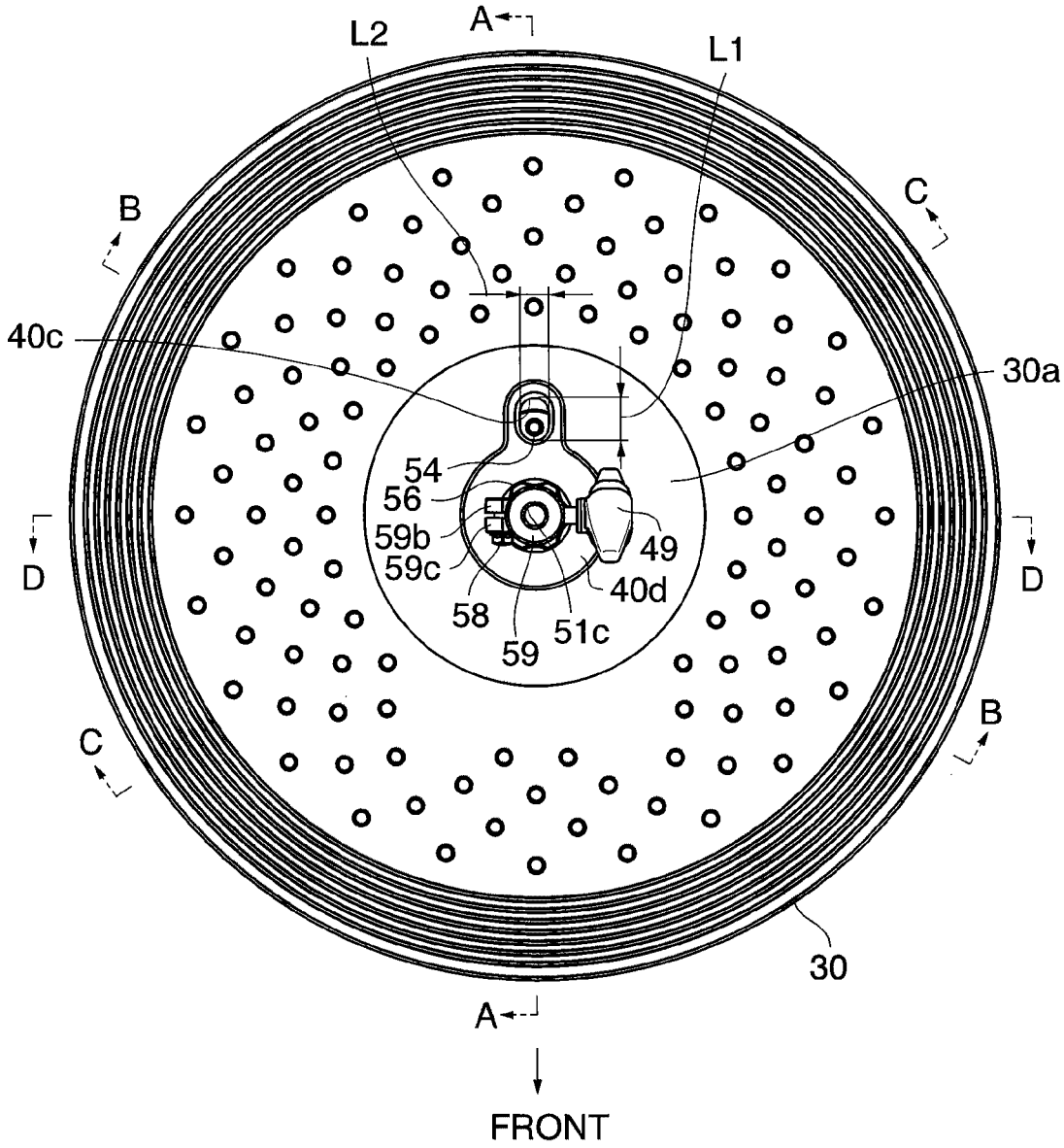
FIG. 3 is a plan view of an HH pad body.
Figure 4:
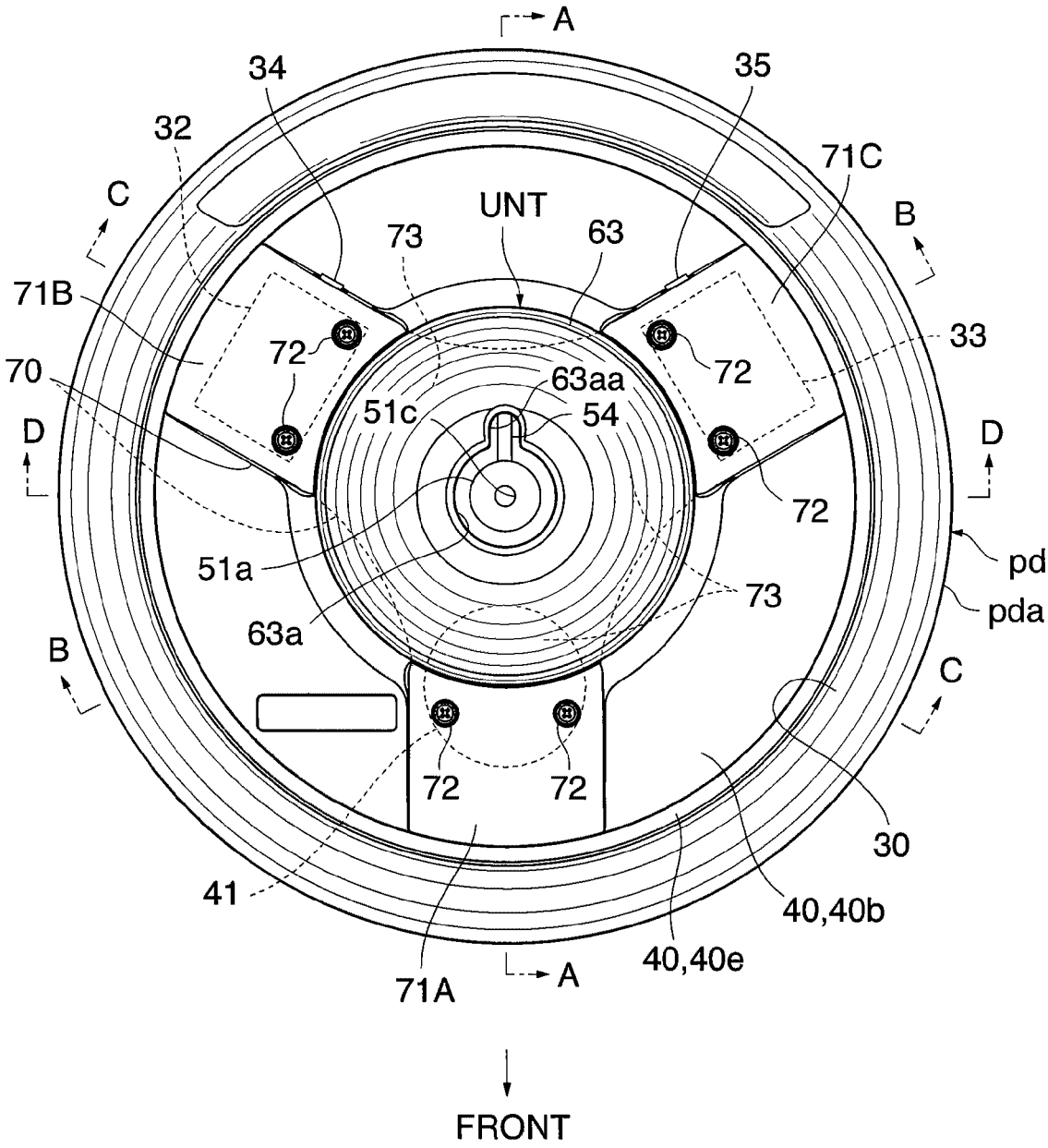
FIG. 4 is a bottom view of the HH pad body.
Figure 5:
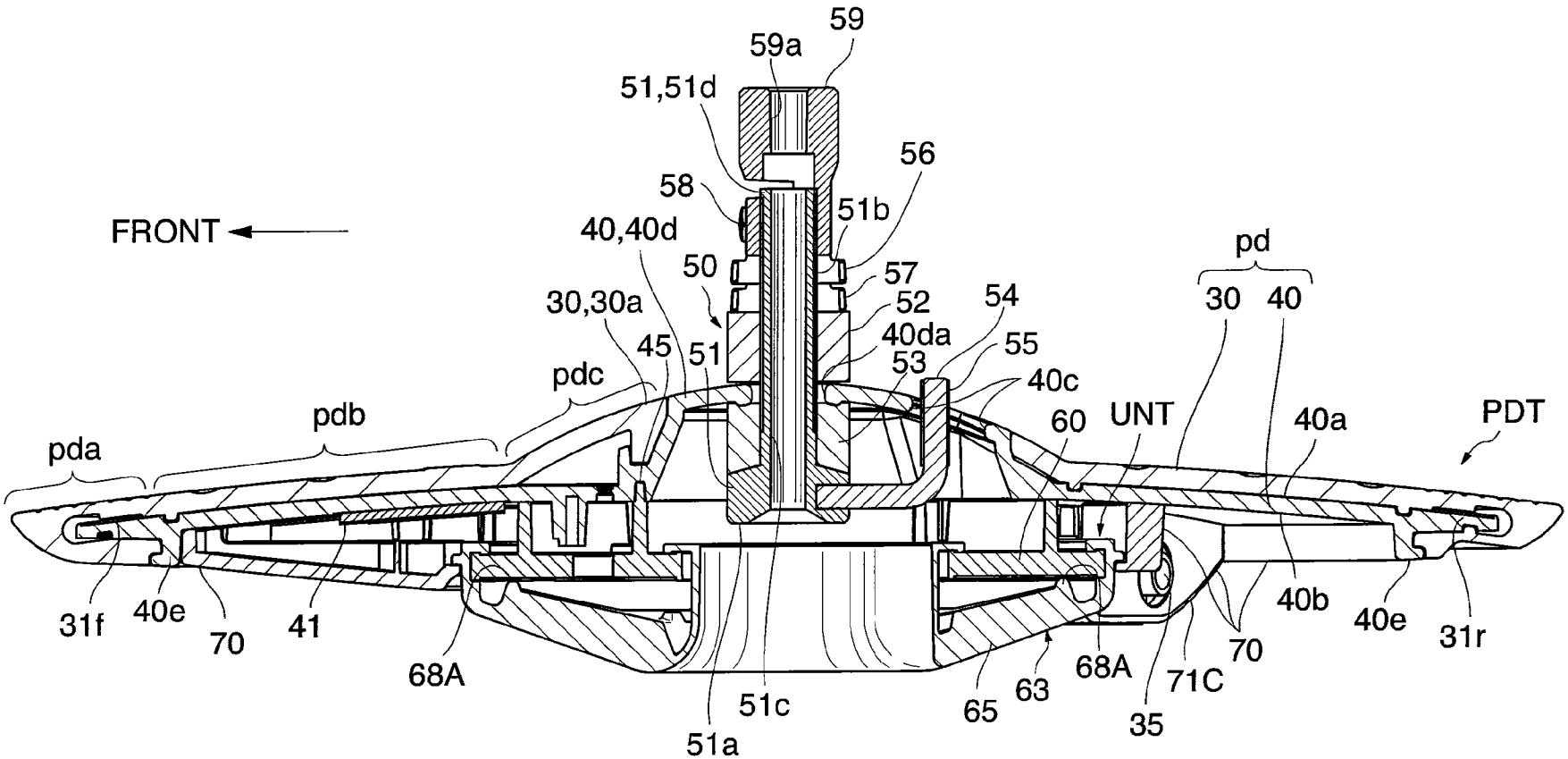
FIG. 5 is a cross section view taken along line A-A in FIG. 3.
Figure 6:
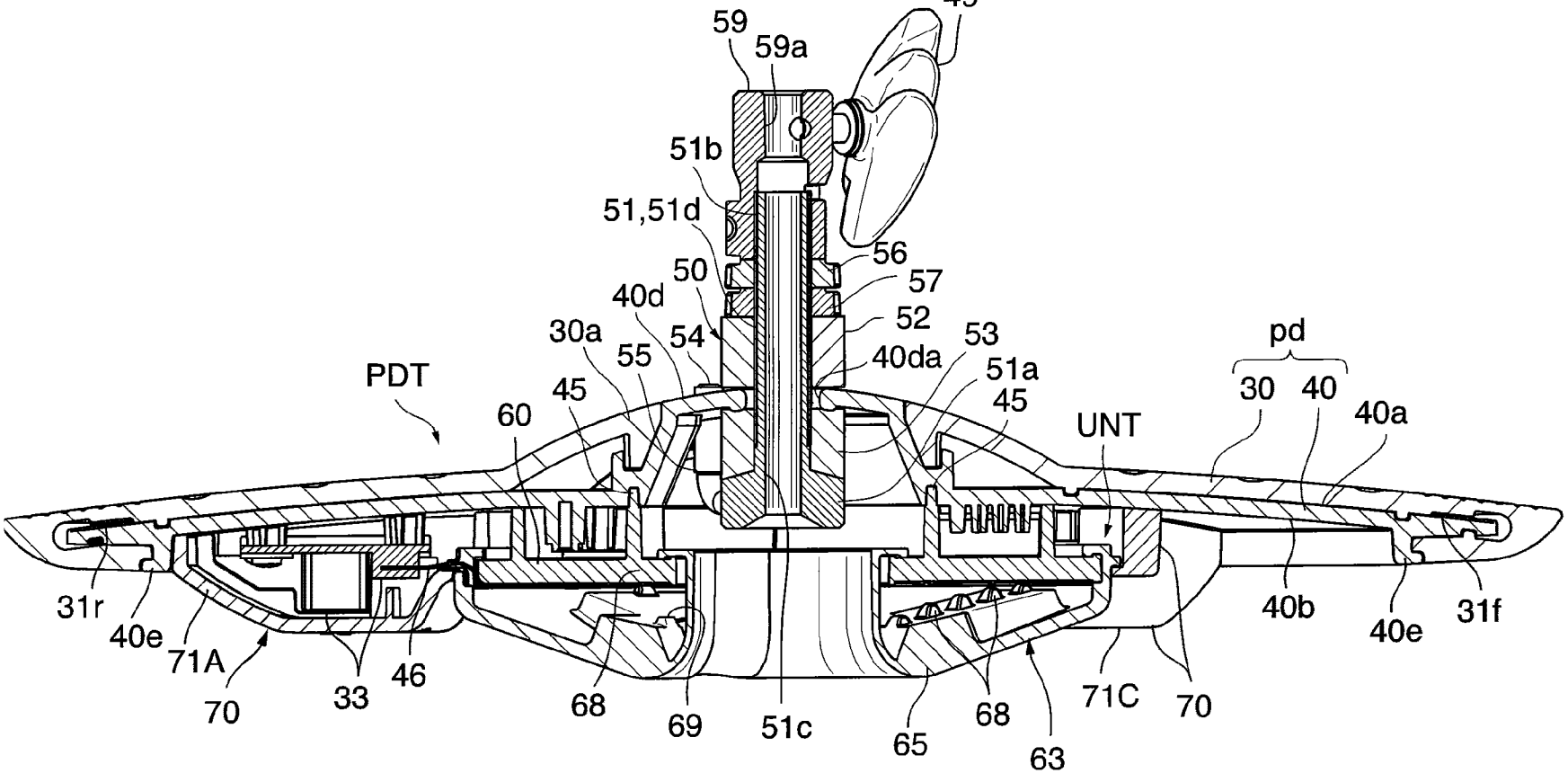
FIG. 6 is a cross section view taken along line B-B in FIG. 3.
Figure 7:
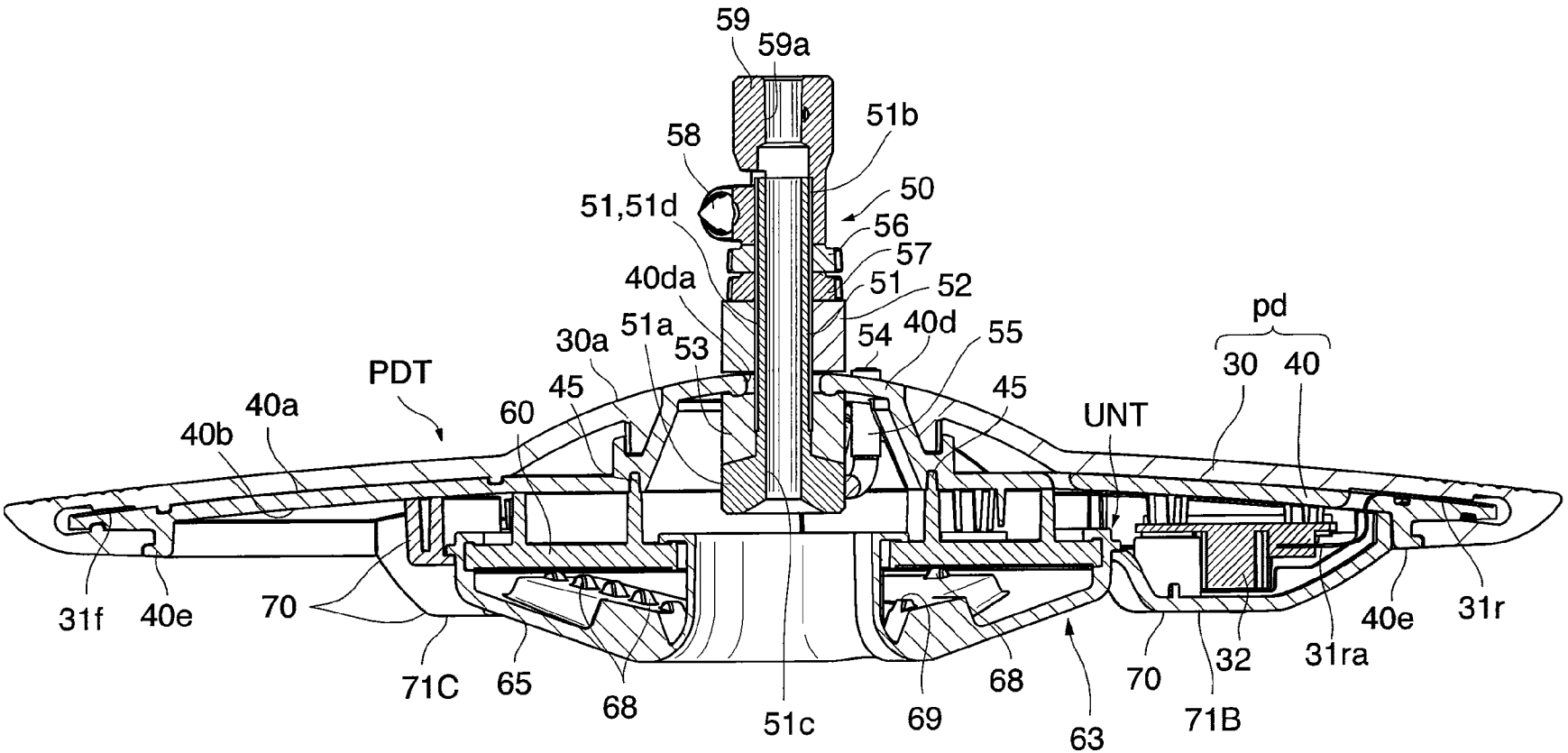
FIG. 7 is a cross section view taken along line C-C in FIG. 3.

FIG. 3 shows the HH pad body PDT in plan view, and FIG. 4 shows the HH pad body PDT in bottom view. FIGS. 5 to 7 are cross section views respectively taken along lines A-A, B-B, and C-C in FIG. 3.

First, the schematic construction will be described. As shown in FIGS. 5 to 7, the HH pad body PDT is mainly comprised of a pad section pd, a rear cover 70, and an operation detecting unit UNT. The pad section pd is mainly comprised of a frame 40 and a rubber pad 30 that provides a percussion surface. The frame 40 is made of a hard material such as PP (polypropylene) that can reduce an undesired vibration by internal loss and can absorb flexure at the time of being strongly struck. The rear cover 70 is made of a material such as EVA (ethylene-vinyl acetate copolymer) softer than the material of the frame 40, so as to be deformed with the flexure of the frame 40 and suppress an undesired vibration produced when and after the pad section pd is struck.

The HH pad body PDT is horizontally supported for pivotal motion by a supporting unit 50, which is fixed to a movable support rod 47 (see FIG. 9) vertically mounted in a stand, not shown. The movable support rod 47 is moved downward when a pedal 48 (see FIG. 9) is depressed, and is moved upward by urging means, not shown, when the pedal depression is released. The supporting unit 50 moves up and down in unison with the movable support rod 47 moved up and down by the pedal operation. Stand parts including from the movable support rod 47 to the pedal 48 are the same in construction as relevant parts of a stand for an acoustic HH, which are commercially available.

As shown in FIGS. 2 and 5, the HH pad body PDT has an upper surface thereof including a cup pdc corresponding to a radially central portion, a circumference portion pda corresponding to an edge, and a ride area (bow) pdb extending between the cup pdc and the circumference portion pda. The cup, the circumference portion, and the ride area are areas which are struck, etc. in performance operation. The cup pdc and the ride area pdb are struck solely by a stick, whereas the circumference portion pda is struck and is also held between fingers of the player from above and below (mute operation).

In addition to the above performance operations by hand, the operation detecting unit UNT of the HH pad body PDT can be brought in contact with the bottom seat 80 by operating the pedal 48 (see FIG. 9), whereby a pedal operation peculiar to the hi-hat cymbal can also be carried out. Especially in this embodiment, the object for which the percussion detection is performed includes not only a front-side area of the HH pad body PDT but also all the other areas including left, right and rear-side areas thereof, thereby capable of improving the performance expression.

In the following, the details of the respective constructions will be described.

As shown in FIGS. 5 to 7, the supporting unit 50 mainly includes a felt supporting member 51 made of metal or the like, a whirl-stop pin 54, felts 52, 53, fixing nuts 56, 57, and a supporting rod fastener 59, which are integrally constructed into one unit. The felt supporting member 51 has a base portion 51*a* which is a jaw, and a cylinder portion 51*d* extends upward from the base portion 51*a* and is formed integrally therewith. The base portion 51*a* and the cylinder portion 51*d* can be formed separately and fixed together by threaded engagement or the like. The whirl-stop pin 54 made of metal or the like is extended rearward from the base portion 51*a*. The whirl-stop pin 54 is formed by a round rod which is bent into an L-shape as seen in side view, and a tip end of the whirl-stop pin 54 extends upward in a vertical direction. The vertical portion of the whirl-stop pin 54 is covered by a cushioning 55 made of polyvinyl chloride or the like. The whirl-stop pin 54 may be formed integrally with the base portion 51*a*.

As shown in FIG. 5, a through hole 40*da* and a whirl-stop hole 40*c* are formed in a supported portion 40*d*, i.e., a radially center portion of the frame. The whirl-stop pin 54 extends through the whirl-stop hole 40*c* of the frame 40 and is exposed upward. As viewed in plan, the whirl-stop pin 54 is disposed within the whirl-stop hole 40*c*.

The felt supporting member 51 is formed with an insertion hole 51*c* into which the movable support rod 47 (see FIG. 9) is inserted. The insertion hole 51*c* vertically extends through the entire felt supporting member 51 from the base portion 51*a* to the cylinder portion 51*d* (see also FIGS. 3 and 4). A male thread 51*b* is formed on the outer periphery of the cylinder portion 51*d*. The cylinder portion 51*d* of the felt supporting member 51 extends through the supported portion 40*d* of the frame 40 with a clearance therebetween.

Doughnut-shaped felts 53, 52 are disposed on the base portion 51*a* of the felt supporting member 51 in the mentioned order, with the supported portion 40*d* of the frame 40 sandwiched therebetween. The cylinder portion 51*d* is inserted into holes formed in the felts 53, 52. The fixing nuts 56, 57 (the fixing nut 56 for preventing the loosening is not inevitably necessary) disposed on the felt 52 are threadedly engaged with the male thread 51*b* of the felt supporting member 51. The felts 52, 53 are held between the fixing nut 57 and the base portion 51*a* with appropriate force, whereby the HH pad body PDT is pivotable relative to the felt supporting member 51 in all the directions such as a front-to-rear direction and a left-to-right direction, using the elasticity of the felts 52, 53. By adjusting the coupling force generated by the fixing nuts 56, 57, the degree of pivot motion of the HH pad body PDT when struck can be adjusted.

The base portion 51*a*, the felts 52, 53 and the fixing nuts 56, 57 of the felt supporting member 51 may be formed into any profile shapes. For example, as long as they are large enough so as not to pass through the through hole 40*da* of the frame 40, they may not be circular in shape. The fixing nuts 56, 57 may not be threadedly fixed to the cylinder portion 51*d* but may be fixed by any construction as long as they can be fixed at desired vertical positions. The felts 52, 53 may not be made of a felt material but made of any other elastic material.

The supporting rod fastener 59 is horizontally slotted into upper and lower halves. The lower half of the supporting rod fastener 59 is vertically slotted into two fastening pieces 59*b*, 59*c* which are closely disposed to each other (see FIG. 3). The lower half of the supporting rod fastener 59 has an inner diameter portion thereof formed with a female thread (not shown) corresponding to the male thread 51*b* of the felt supporting member 51. The lower half of the supporting rod fastener 59 is threadedly engaged with an upper end portion of the felt supporting member 51, and the two fastening pieces 59*b*, 59*c* are fastened together by a screw 58 (see FIGS. 3, 5 and 7), whereby the upper end portion of the felt supporting member 51 is tightened by the lower half of the supporting rod fastener 59. Thus, the supporting rod fastener 59 is fixedly mounted to the felt supporting member 51. An upper end of the cylinder portion 51*d* is positioned near an upper end of the lower half of the supporting rod fastener 59.

The supporting rod fastener 59 is provided with a clinching knob 49. When the knob 49 (see FIGS. 2, 3 and 6) is tightened in a state that the movable support 47 (see FIG. 9) is inserted into the insertion hole 59*a* in the upper half of the supporting rod fastener 59, a tip end of the knob 49 depresses the movable support rod 47 in the insertion hole 59*a*, whereby an outer peripheral surface of the movable support rod 47 is brought in press-contact with an inner peripheral surface of the insertion hole 59*a*. As a result, the entire supporting unit 50 is coupled and fixed to the movable support rod 47 via the supporting rod fastener 59. When the movable support rod 47 is moved up and down, the supporting unit 50 therefore moves up and down in conjunction therewith. Since the supporting rod fastener 59 is fixed to the movable support rod 47 by the above described press-contact mechanism, even if the movable support rod 47 is formed by a simple rod provided with no screws or the like, the supporting unit 50 can easily be coupled and fixed to the movable support rod 47.

The mechanism for causing the outer peripheral surface of the movable support rod 47 to be brought in press contact with the inner peripheral surface of the insertion hole 59*a* is not limited to the above described example. For example, as in the case of the lower half of the supporting rod fastener 59, the press contact mechanism may be one having slotted parts adapted to be tightened together by a screw.

The fixed coupling between the supporting rod fastener 59 and the movable support rod 47 can be established and released by tightening and loosing the knob 49 of the supporting rod fastener 59. Even if the knob 49 is somewhat loosened at that time, the entire supporting unit 50 remains one piece, and therefore the HH pad body PDT remaining attached to the supporting unit 50 can be mounted to and dismounted from the movable support rod 47.

The HH pad body PDT is separated from the supporting unit 50 by releasing the threaded engagement of the supporting rod fastener 59 and the fixing nuts 56, 57 with the felt supporting member 51 in the supporting unit 50 and by pulling out the felt supporting member 51 downward from the through hole 40*da* of the frame 40. The HH pad body PDT can therefore be handled separately from the supporting unit 50, and they can be made less bulky and convenient for sale and transportation, for example.

As shown in FIGS. 5 to 7, the rubber pad 30 is fixed to an upper side of the frame 40 by a double-sided tape, not shown, or by adhesive. At the circumference portion pda, the rubber pad 30 extends from the upper side of the frame 40 to a lower side thereof to hold a circumference portion of the frame 40 from above and below. The supported portion 40*d* of the frame 40 is positioned radially inside of that part 30*a* of the rubber pad 30 corresponding to the cup pdc. The supported portion 40*d* is exposed upward.

Figure 8A:
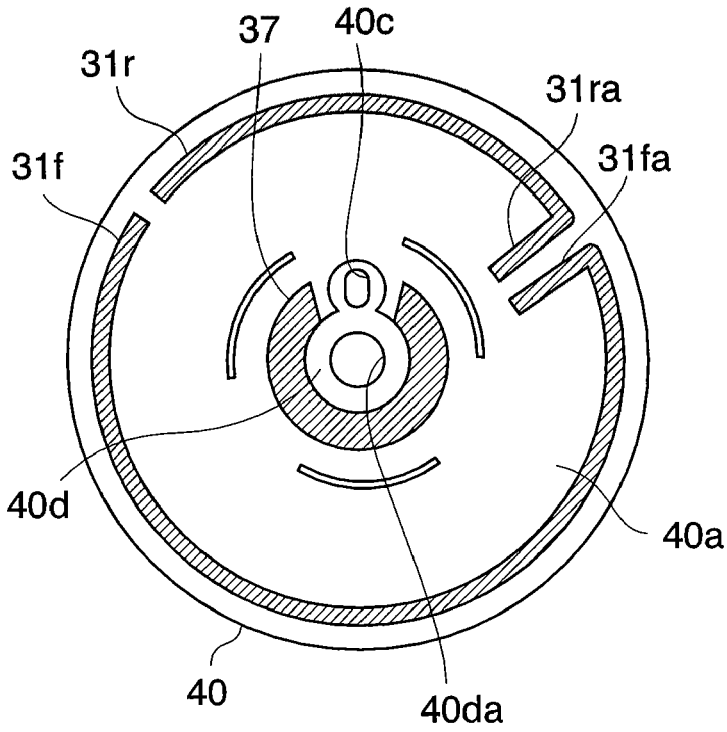
FIG. 8A is a plan view of a frame.
Figure 8B:
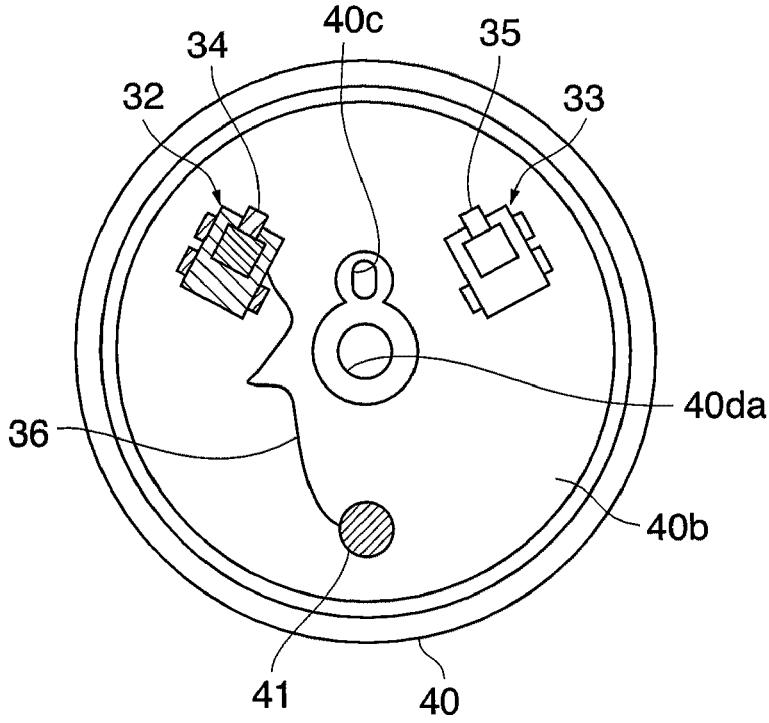
FIG. 8B is a rear view of the frame.

FIG. 8A shows the frame 40 in plan view, and FIG. 8B shows the frame 40 in rear view. The frame 40 is formed with the through hole 40*da*, and is formed into a circular shape as viewed in plan. As shown in FIG. 8A, the sheet sensors 31*f*, 31*r* are disposed on and fixed by adhesive to an upper surface 40*a* of the circumference portion of the frame 40 (see also FIG. 1 and FIGS. 5 to 7). The sheet sensor 31*f* is disposed over more than half area of the frame 40 on the front side. On the other hand, the sheet sensor 31*r* is disposed on a rear side area of the frame 40 on which the sheet sensor 31*f* is not disposed. The sheet sensors 31*f*, 31*r* cooperate with each other to form a substantially annular shape. Sensor lead portions 31*fa*, 31*ra* extend radially inward from the sheet sensors 31*f*, 31*r*.

As shown in FIG. 8A, the sheet sensor 37 is disposed on the upper surface 40*a* of the frame 40 at a location radially outward of the supported portion 40*d*. The sheet sensor 37 is formed into a substantially annular shape at a location avoiding the whirl-stop hole 40*c*. The sheet sensors 31*f*, 31*r* and 37 may be film-shaped sensors of a piezoelectric type, a capacitor type, or any other type so long as they are each able to detect a pressure change and independently output a detection signal.

As shown in FIG. 8B, the single piezosensor 41 (see also FIGS. 1 and 5) is disposed on and fixed by adhesive or the like to a rear surface 40*b* of the frame 40. The piezosensor 41 is disposed on the lower surface of the frame 40 at a location slightly inward of the circumference portion and corresponding to the ride area pdb. The piezosensor 41 is constituted by a piezoelectric device, and may be of any construction as long as it is able to detect a vibration.

Furthermore, signal output units 32, 33 are disposed on the rear surface 40*b* of the frame 40. The piezosensor 41 is connected via a signal line 36 to the signal output unit 32. The signal output unit 32 has an output terminal 34 from which a detection signal of the piezosensor 41 is output to the outside. The sensor lead portions 31*fa*, 31*ra* (see FIG. 8A) and a sensor lead portion (not shown) of the sheet sensor 37 are electrically connected to the signal output unit 32. Detection signals of these sensors are output from the output terminal 34 to the outside. The signal output unit 33 has an output terminal 35 from which a detection signal of the below-described operation detecting unit UNT is output to the outside.

The piezosensor 41 detects a vibration mainly produced when the ride area pdb is struck, and outputs a detection signal indicating whether or not striking is made and the strength of the striking. The sheet sensor 37 detects striking to the cup pdc, and outputs a detection signal indicating whether or not the striking is made and the strength of the striking. The sheet sensors 31*f*, 31*r* detect striking to the circumference portion pda and a mute operation of depressing the circumference portion from above and below, and output a detection signal indicating whether or not the striking and the mute operation are made and the strength of the striking.

The sheet sensors 31*f*, 31*r* are the same in width and are each uniform in width over the entire length thereof. However, the width may vary along the lengthwise position. For example, the width may be widened on the left and right sides where the striking position on the circumference portion can be inaccurate. The sensors 31*f*, 31*r* may also be different in sensitivity. Alternatively, a sensitivity adjustment mechanism may be provided. The upper surface of the rubber pad 30 may be designed such that a boundary between the sheet sensors 31*f* and 31*r* can be found. Sheet sensors for detection of mute operation, which are equivalent to the sheet sensors 31, may further be provided on the rear surface 40*b* of the frame 40.

As shown in FIG. 3, the whirl-stop hole 40*c* of the frame 40 is an elongated hole extending in the front-to-rear direction. The length of the whirl-stop hole 40*c* in the front-to-rear direction is L1, and the length thereof in the left-to-right direction is L2 which is shorter than L1. The whirl-stop pin 54 extending through the whirl-stop hole 40*c* is formed into a circular shape in cross section. When a musical performance is not performed, the whirl-stop pin 54 extends through the whirl-stop hole 40*c* and projects upward. The whirl-stop pin 54 is disposed at a location close to and slightly deviated rearward from the center of the HH pad body PDT in the radial direction, and therefore does not hinder a musical performance and is not unpleasant to the player's eye.

During a musical performance, the HH pad body PDT can be horizontally rotated relative to the supporting unit 50. However, the whirl-stop pin 54 is brought in contact and engagement with left and right inner wall surfaces of the whirl-stop hole 40*c*, whereby a range of rotation angle of the HH pad body PDT is restricted. The HH pad body PDT is pivoted when struck, however, a range of pivotal angle thereof is restricted by the engagement between the whirl-stop pin 54 and the whirl-stop hole 40*c*.

For example, when a frontmost portion of the HH pad body PDT is struck and the HH pad body PDT is pivoted in the front-to-rear direction, the whirl-stop pin 54 is brought in contact and engagement with the front and rear inner wall surfaces of the whirl-stop hole 40*c*, thereby restricting a range of pivotal angle of the HH pad body PDT in the front-to-rear direction. When a left or right portion of the HH pad body PDT is struck and the HH pad body PDT is pivoted in the left-to-right direction, the whirl-stop pin 54 is brought in contact and engagement with the right and left inner wall surfaces of the whirl-stop hole 40*c*, thereby restricting a range of pivotal angle of the HH pad body PDT in the left-to-right direction. Similarly, when the HH pad body PDT is not pivoted in the front-to-rear direction and the left-to-right direction, but pivoted in an oblique direction, a range of pivotal angle in that direction is restricted.

Since there is a relation of L1>L2, the distance between the whirl-stop pin 54 and the inner wall surface of the whirl-stop hole 40*c* is larger in the front-to-rear direction than in the left-to-right direction. Therefore, the HH pad body PDT is largely pivotable in the front-to-rear direction than in the left-to-right direction. As a result, a maximum pivotable amount of the HH pad body PDT is made different depending on the direction, resulting in a natural and appropriate pivotal motion.

When the frame 40 is struck, detection signals can be output from two or more of the piezosensor 41 and the sheet sensors 31*f*, 31*r* and 37. It is possible to arbitrarily set how and which of the sensor signals should be used for musical tone control. For example, a sensor signal which has the largest value may simply be used for musical tone control. The sheet sensors 31*f*, 31*r* may be used solely for detection of mute operation or detection of striking to the circumference portion pda.

Alternatively, detection signals of the sheet sensors 31*f*, 31*r* may be used for detection of the striking in cooperation with the piezosensor 41 and for judgment of the striking position. Further alternatively, the detection of striking to the cup pdc may be performed based solely on a detection signal of the piezosensor 41 without using outputs of the sheet sensors 37.

In this embodiment, the CPU 11 carries out musical tone control by way of example as follows: First, the presence/absence (timing) of striking and a striking position are totally determined based on output signals of the sensors. Whether the striking position is in the front side area or in the rear side area of the circumference portion pda is determined based on the output signals of the two sheet sensors 31*f*, 31*r*. Whether the striking position is in the front side area or in the rear side area of the ride area pdb is also determined based on the output signals of the sheet sensors 31*f*, 31*r*.

Then, a tone color to be sounded is made different depending on which of the front and rear side areas of the circumference portion pda, the front and rear side areas of the ride area pdb, and the cup pdc is struck. Thus, when the rear side is struck, a musical tone is generated whose tone color differs from that of a musical tone generated when the front side is struck, whereby performance expression is improved. It is possible to arbitrarily set whether a priority should be given to the latest sensor detection signal and a musical tone currently sounded should be erased, or a new musical tone should be sounded in superposition to the musical tone currently sounded. In this embodiment, by way of example, a new musical tone is sounded in superposition to a musical tone currently sounded, without erasing the musical tone currently sounded.

As for the detection of mute operation, it is determined that a mute operation is performed for example when either one of the sheet sensors 31*f*, 31*r* outputs a signal indicating that the sensor has been depressed for a predetermined time in a state that the piezosensor 41 does not produce an output. When a mute operation is performed, control is made to attenuate all of musical tones currently sounded. It should be noted that the output signal only from the sheet sensor 31*f* may be used for the detection of mute operation.

As shown in FIG. 4, the rear cover 70 includes a base portion 73 that covers a radially center portion of the pad section pd from below and three arm portions 71 (71A, 71B, 71C) radially extending from the base portion 73 to the circumference portion pda of the pad section pd, and is integrally formed into one piece. The rear cover 70 is disposed on the rear surface 40*b* of the frame 40. Each arm portion 71 of the rear cover 70 has its tip end portion fitted to a projecting part 40*e* of the circumference portion of the frame 40 that projects downward (see FIGS. 5 to 7). The rear cover 70 is fixed to the frame 40 using screws 72. The rear cover 70 may be adhered to the frame 40. Each arm portion 71 has it length equal to or larger than the half of the radius of the HH pad body PDT.

The rear cover 70 cooperates with the frame 40 to function to convey a vibration of the pad section pd. As shown in FIGS. 4 and 8B, the piezosensor 41 is disposed as viewed in plan at a location where there is one of the arm portions (arm portion 71A). Thus, the vibration of the pad section pd produced when it is struck is appropriately and effectively conveyed to a striking detection unit. As shown in FIG. 4, the signal output units 32, 33 are disposed as viewed in plan at locations where there are the arm portions 71B, 71C. The signal line 36 (see FIG. 8B) is hidden from below mainly by the base portion 73 of the rear cover 70. As a result, the piezosensor 41, the signal output units 32, 33 and the signal line 36 are protected and made invisible from outward.

Furthermore, since the signal output units 32, 33, and the piezosensor 41 are disposed on the different arm portions 71, the weight balance of the entire HH pad body PDT can easily be made appropriate. The arm portions 71 may be formed into different shapes and thicknesses. Since the arm portions 71 extend radially, they are easily designed to have different shapes in order that the HH pad body PDT has a desired weight balance, for example.

When strongly struck, the pad section pd is flexed, which generates a vibration other than a vibration produced directly by the striking. The rear cover 70 appropriately attenuates the vibration of the pad section pd, and functions to suppress an erroneous action caused by the vibration due to the flexure of the pad section pd. In a case that the rear cover 70 is formed into a circular shape as viewed in plan and extends to the circumference portion pda of the pad section pd, the pad section pd is high in vibration suppressing effect. On the other hand, if the rear cover 70 is formed into a circular shape, a vibration produced in the circumference portion pda is excessively dispersed through or absorbed by the rear cover. Thus, in some cases, a vibration produced by the striking is not appropriately conveyed to the piezosensor 41.

To obviate this, in this embodiment, the rear cover 70 is formed into a radial shape and the arm portions 71 are extended to the circumference portion pda of the pad section pd. With this construction, an undesired vibration can effectively be suppressed, without excessively hindering the conveyance of a vibration produced by the striking. As compared to a rear cover formed into a circular shape, the rear cover 70 is made light in weight, and the weight of the rear cover 70 is concentrated on the center of the HH pad body PDT, whereby a pivotal motion of the HH pad body PDT is made more natural.

Outer ends of the signal output units 32, 33 are positioned inside tip ends of the arm portion 71B, 71C as viewed in the radial direction of the HH pad body PDT. Since the output terminal 34, 35 of the signal output units 32, 33 project from lateral sides of the signal output units 32, 33, they are positioned inside the tip ends of the arm portions 71B, 71C. Thus, the circumference portion of the HH pad body PDT and its vicinity are prevented from becoming unstable by the weight of cords connected to the output terminal 34, 35. A free motion of the HH pad body PDT is not significantly hindered by the cord weight.

Figure 9:
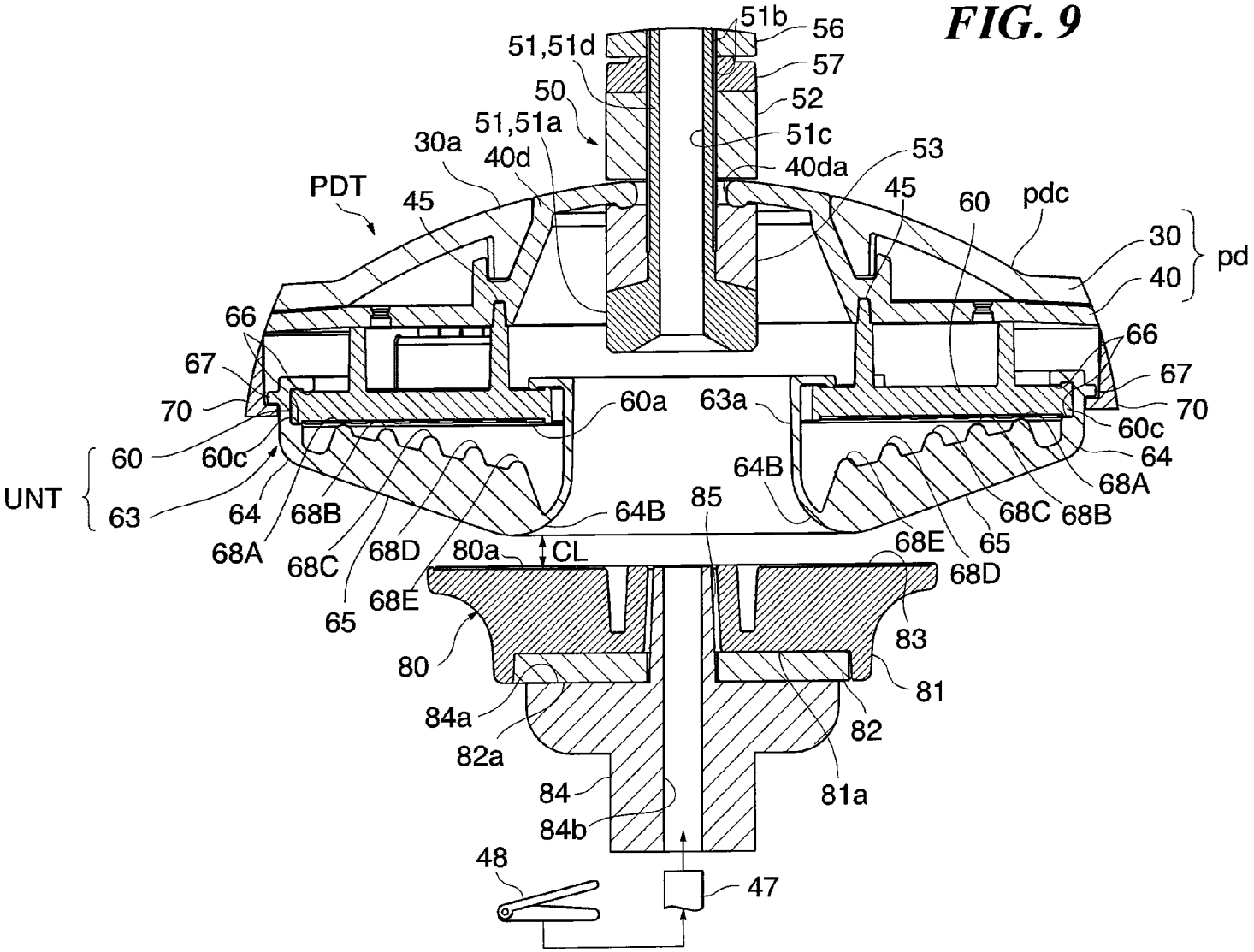
FIG. 9 is a fragmentary cross section view, taken along line D-D in FIG. 4, of the HH pad body and a bottom seat.

FIG. 9 shows the HH pad body PDT and the bottom seat 80 in fragmentary cross section taken along line D-D in FIG. 4. The operation detecting unit UNT is a lowermost part of the HH pad body PDT and disposed below the rear cover 70 (see FIG. 2, FIGS. 4 to 7 and FIG. 9). As shown in FIG. 9, etc., the operation detecting unit UNT is comprised of a base plate 60 and a rubber-based elastic member 63 disposed below the base plate 60, each of which is formed into a doughnut shape as viewed in plan.

An inwardly concaved nip portion 66 and an engagement portion 67 adjacent to the nip portion 66 are formed at an outer edge portion or upper portion of the elastic member 63. The engagement portion 67 is formed into a protruded ridge that protrudes outward. A plurality of pins 45 are formed in an upper surface of the base plate 60 to project therefrom (see FIGS. 5 to 7 and FIG. 9), and fitted to the frame 40, whereby the base plate 60 is fixed to the frame 40. The circumference portion of the base plate 60 is sandwiched and held by the nip portion 66 from above and below. The engagement portion 67 of the elastic member 63 is engaged with and fixed to the rear cover 70. As described above, the operation detecting unit UNT is fixed to the frame 40 and the rear cover 70.

Figure 10A:
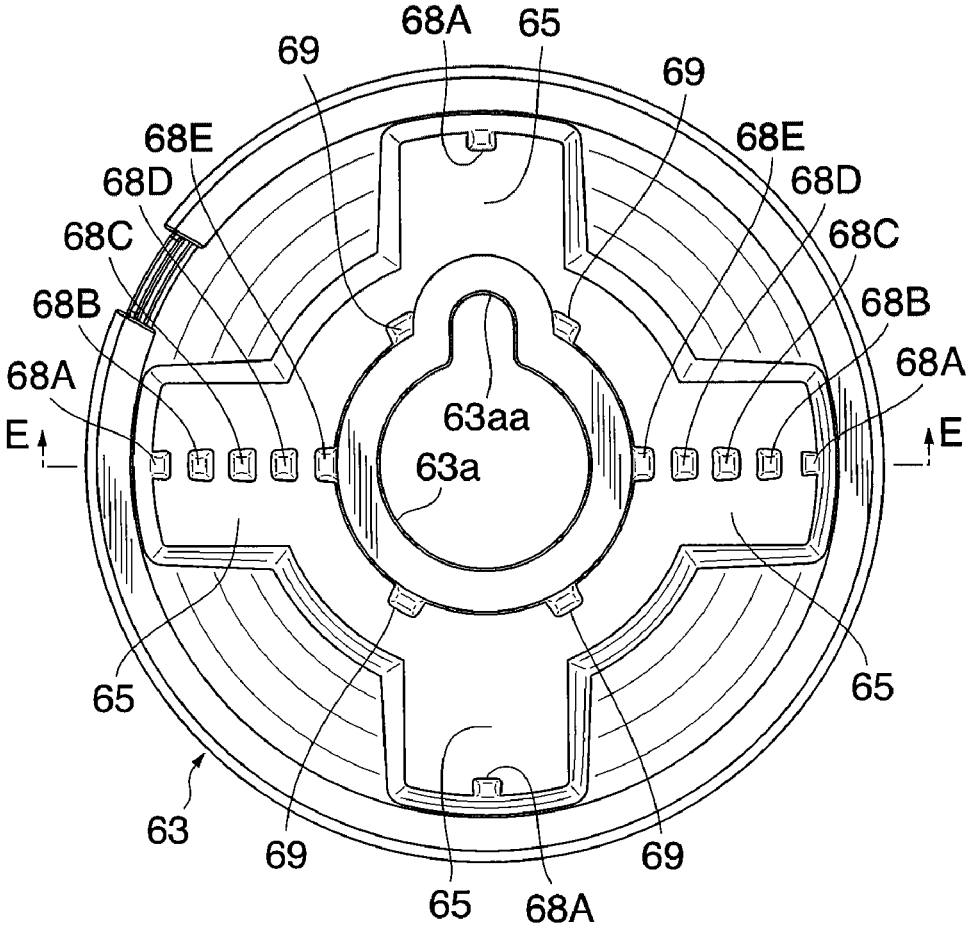
FIG. 10A is a plan view of an elastic member.
Figure 10B:
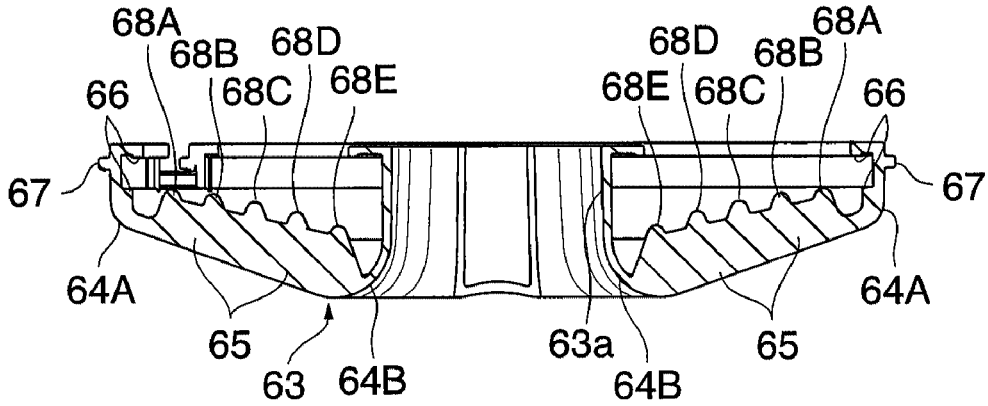
FIG. 10B is a cross section taken along line E-E in FIG. 10A.

FIG. 10A shows the elastic member 63 in plan view, and FIG. 10B is a cross section view taken along line E-E in FIG. 10A. As shown in FIGS. 9, 10A and 10B, the elastic member 63 is formed at a radially center part with a through hole 63*a*, and includes a thin-walled skirt portion 64B formed around a lower part of the through hole 63*a*, and a thick-walled base portion 65 located radially outward of the skirt portion 64B, and a skirt portion 64A extending between the base portion 65 and the outer edge portion. The base portion 65 has it lower surface which is slanted downward toward radially inward.

The through hole 63*a* has a run-off portion 63*aa* extending rearward in a direction in which a bottom portion of the whirl-stop pin 54 of the supporting unit 50 extends (see FIGS. 4 and 10A). When the HH pad body PDT remaining mounted with the operation detecting unit UNT is mounted to and dismounted from the supporting unit 50, the run-off portion 63*aa* prevents the interference between the elastic member 63 and the whirl-stop pin 54. Specifically, the cylinder portion 51*d* of the felt supporting member 51 of the supporting unit 50 has an outer diameter smaller than the diameter of the through hole 40*da* of the frame 40, and a clearance is defined therebetween. By inserting and extracting the felt supporting member 51 into and from the through hole 40*da* after the felt supporting member 51 is slightly shifted forward relative to the HH pad body PDT, the HH pad body PDT can be mounted to and dismounted from the supporting unit 50 without causing the interference between the elastic member 63 and the whirl-stop pin 54. The run-off portion 63*aa* may be increased large enough for the felt supporting member 51 to be inserted into and extracted from the through hole 40*da* without being shifted relative to the HH pad body PDT.

The elastic member 63 is made of an elastic material harder than the rubber pad 30, and when depressed in the vertical direction, the entire base portion 65 is displaced upward mainly by the elasticity of the skirt portions 64A, 64B so as to be able to move toward and away from the base plate 60. The base portion 65 has its upper surface on which actuators 68 (68A to 68E) are projectingly formed integrally therewith. The actuators 68A are coaxially disposed at four places (front, rear, left and right) centering around the radial center of the elastic member 63, and the actuators 68B to 68E are disposed at two places (left and right). The actuators 68A to 68E are projectingly disposed in this order from radially outward toward radially inward.

As shown in FIG. 10B, upper end positions of the actuators 68A to 68E are lower in this order. The actuators 68A are highest in upper end position. Stoppers 69 are projectingly provided at four places (diagonally forward left and right and diagonally rearward left and right) coaxially with the actuators 68E. Although not shown in the drawings, the stoppers 69 have the same height as that of the actuators 68D.

Figure 11A:
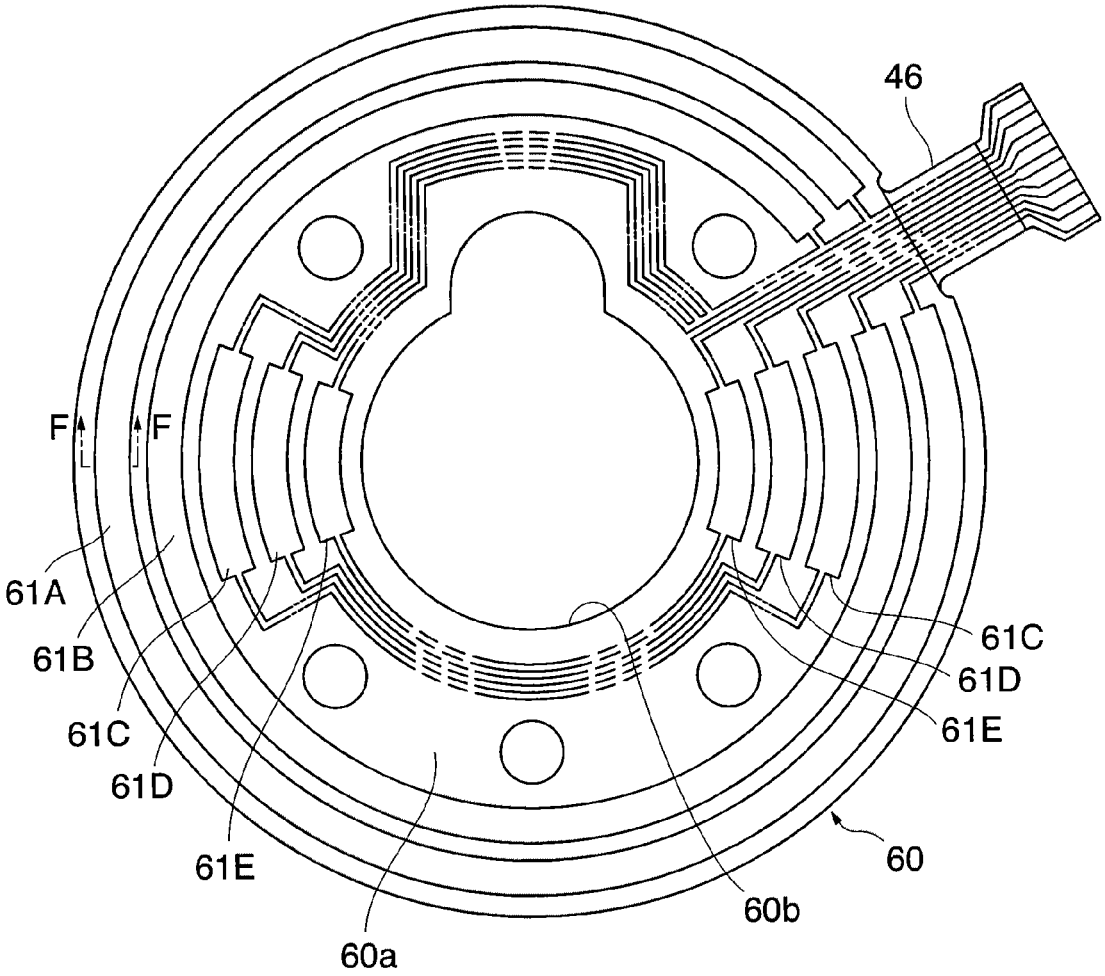
FIG. 11A is a bottom view of a base plate.
Figure 11B:
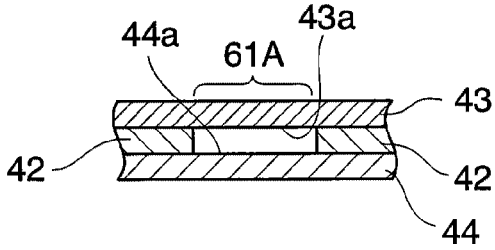
FIG. 11B is a cross section view of the base plate taken along line F-F in FIG. 11A.

FIG. 11A shows the base plate 60 in bottom view, and FIG. 11B is a cross section view taken along line F-F in FIG. 11A. A through hole 60*b* is formed at a radially center part of the base plate 60. A plurality of sheet switches 61 (61A to 61E) corresponding to the actuators 68A to 68E of the elastic member 63 are disposed on a flat lower surface or installation surface 60*a* of the base plate 60. A sensor lead portion 46 is extended from each of the sheet switches 61 on the left side of the rear half of the base plate 60, and is connected to the signal output unit 33 (FIGS. 4, 6, 8B).

The sheet switches 61A to 61E are formed into substantially annular or circular arc shapes having different curvature radius (different radial positions) as viewed in plan. These sheet switches 61A to 61E are disposed from radially outward toward radially inward in this order. The outermost sheet switch 61A is formed into an annular shape as viewed in plan except for that part at which the sensor lead portion 46 is disposed. Thus, it can be said that the outermost sheet switch 61A is substantially annular in shape. This also applies to the next outermost sheet switch 61B. Due to the difference in curvature radius, the sheet switch 61A is slightly longer than the sheet switch 61B in installation length. The sheet switches 61C to 61E are disposed at two places on the left and right sides. The sheet switches 61C to 61E are circular in shape. More outward sheet switches are longer in circular arc length.

As described later, when a pedal operation is performed, the actuators 68A to 68E of the elastic member 63 are moved toward and away from the sheet switches 61A to 61E. When each of the actuators 68 is brought in contact with and depresses the corresponding sheet switch 61, the depressed sheet switch 61 outputs a signal indicating the operation is on. The sheet switches 61 have the same construction. By way of example, the construction of the sheet switch 61A is described. As shown in FIG. 11B, a spacer 42 is interposed between a lower sheet 43 and an upper sheet 44. The sheet switch 61A is constructed by a space portion in which the spacer 42 is not present. When contacts 43*a*, 44*a* provided on the opposing surfaces of the lower sheet 43 and the upper sheet 44 are made in contact with each other, a signal indicating the closure of these contacts is output, whereby it is detected that the operation is turned on.

The operation detecting unit UNT includes five groups each consisting of the relevant one or ones of the sheet switches 61 and the corresponding actuators 68. Since the installation surface 60*a* is made horizontal, the distance between the sheet switch 61 and the actuator 68 is smaller in the more radially outward group of sheet switches 61 and actuator 68 in a state that a pedal operation is not performed (see FIGS. 9 and 10A). When the base portion 65 is moved upward by a pedal operation, the sheet switches are depressed by the corresponding actuators 68 and output detection signals in the order from the sheet switch 61A of the radially outwardmost group.

As shown in FIG. 9, the bottom seat 80 is supported by a seat support member 84. The seat support member 84 is formed at its center with an insertion hole 84*b*. The seat support member 84 is fixed to a stand, not shown, using a faster in a state that the movable support rod 47 is slidably inserted into the insertion hole 84*b*. Thus, the seat support member 84 is not movable up and down during musical performance. The seat support member 84 may be any form in which the seat support member 84 is vertically fixed relative to the installation surface and the movable support rod 47 is permitted to vertically move. In response to an operation of depressing the pedal 48, the movable support rod 47 is slidingly moved in the insertion hole 84*b* in the vertical direction. A positioning support rod 85 is formed to project upward at a radially center part of the seat support member 84.

The bottom seat 80 is comprised of a heavy weight member 81 made of metal such as aluminum and an elastic member 82, and is formed into a doughnut shape, which is substantially inverted trapezoid in side view. The heavy weight member 81 is not limited to being made of metal, but may be made of a material having substantial weight. The elastic member 82 is made of an elastic material such as rubber and hard sponge, which is harder than the elastic member 63 of the operation detecting unit UNT. Preferably, the elastic member 82 is configured such that it is hard to be elastically deformed in an initial stage upon receipt of a depression force, but is elastically deformed with a light force after start of deformation.

A recess 81*a* is formed in a lower part of the heavy weight member 81, and the elastic member 82 is fitted in the recess 81*a*. A thin sliding member 83 is affixed to an upper part of the heavy weight member 81. A positioning support rod 85 projecting upward from the seat support member 84 is inserted into a hole formed at a radially center part of the bottom seat 80. A lower surface 82*a* of the elastic member 82 is in contact with a supporting surface 84*a* or upper surface of the seat support member 84. Thus, the bottom seat 80 is not fixed to the seat support member 84, but is simply placed thereon.

In this state, a distance CL is ensured between a flat upper surface 80*a* of the bottom seat 80, which is an upper surface of the sliding member 83, and a lowermost end of the elastic member 63 of the operation detecting unit UNT. Thus, the bottom seat 80 is separately constructed from the HH pad body PDT and disposed beneath the HH pad body PDT. The distance CL can arbitrarily be adjusted by adjusting the vertical position of the HH pad body PDT relative to the movable support rod 47 or by adjusting the vertical position of the seat support member 84 relative to the stand (not shown). Since the HH pad body PDT is moved downward while being pivoted, the sliding member 83 is disposed over a region large enough to cover the entirety of a range in which the elastic member 63 can be brought in contact with the sliding member 83.

The sliding member 83 is comprised of a ultrahigh molecular weight polyethylene-based film, but is not limited thereto. The sliding member 83 may be made of any material with which the elastic member 63 is made in smooth sliding contact at the time of pedal operation. Preferably, the sliding member 83 has a slippery surface such as a seal board, and are high in self-lubricity and in abrasion resistance. The thickness of the sliding member 83 formed into a sheet is not limited. The material of the sliding member 83 described above is a mere example, and may be metal. The upper surface of the heavy weight member 81 may be coated with fluorine, nylon-based resin, or polyurethane-based resin. Alternatively, the heavy weight member 81 may be made of the above described slippery material, and a part corresponding to the sliding member 83 may be formed integrally with the heavy weight member 81.

With the above described construction, when the player depresses the pedal 48 (see FIG. 9), the HH pad body PDT is moved downward together with the HH pad body PDT in a forward stroke of the pedal operation, and the elastic member 63 of the operation detecting unit UNT is brought in contact with the upper surface 80*a* of the bottom seat 80. At that time, the HH pad body PDT struck with a stick is still being pivoted in some cases. Thus, the HH pad body PDT is not always moved downward in a state it is horizontal, and is sometimes brought in contact with the bottom seat 80 in a state it is inclined. Even in such a case, the lubricity of the sliding member 83 permits the elastic member 63 to smoothly slide along the upper surface 80*a* of the bottom seat 80, whereby the posture of the HH pad body PDT is automatically corrected to be horizontal.

In the detection by the sheet switches 61, the actuators 68A are first brought in contact with the outermost sheet switch 61A in the forward stroke of the pedal operation, and a detection signal is output. Since in particular the actuators 68A are disposed at four places (front, rear, left, and right) circumferentially spaced from one another (see FIG. 10A), any one actuator 68A is made in press-contact with the corresponding sheet switch 61A whereby ON can be detected, even if the HH pad body PDT is inclined in any direction in an initial stage of contact between the elastic member 63 and the bottom seat 80. Since the sheet switch 61A is formed into a substantially annular shape, it is ensured that the sheet switch 61A is depressed by the actuator 68A, even if the contact position is somewhat deviated in the circumferential direction due to the elastic member 63 being somewhat deformed.

In the forward stroke of the pedal operation, when the next and subsequent actuators 68B, etc. are made in contact with the sheet switches 61B, etc., the posture of the HH pad body PDT is already corrected to be substantially horizontal. Thus, it is ensured that the actuators 68A to 68E are sequentially made in contact with the corresponding sheet switches 61, and the operation ON is detected in sequence. In the forward stroke of the pedal operation, the angle of the lower surface of the base portion 65 becomes gradually close to horizontal. When all the groups of actuators and sheet switches are made ON, the lower surface of the base portion 65 becomes substantially horizontal.

At the same time when the contact is made between the actuators 68D and the sheet switches 61D of a fourth group, the stopper 69 is brought in contact with the installation surface 60*a* of the base plate 60. No sheet switch 61 is provided in that part of the installation surface 60*a* of the base plate 60 with which the stopper 69 is made in contact. After the contact between the stopper 69 and the installation surface 60*a*, if the player further depresses the pedal while perceiving a feeling of resistance, the actuators 68E are made in contact with the sheet switches 61E. Thus, a realistic feeling of pedal operation can be attained.

The sheet switch 61B may be formed into a circular arc shape, as with the sheet switches 61C to 61E. In a case that the inclination of the HH pad body PDT is not adequately corrected before the group of the actuators 68B and the sheet switch 61B is made ON, the actuators 68B may be provided at four places, as with the actuators 68A, to improve the reliability.

In a musical performance by the electronic pads PD, there are played open hi-hat in which the pad section pd is struck with a stick without a pedal operation, closed hi-hat in which the pad section pd is struck with a stick in a state that the pedal 48 is depressed, and striking with a pedal in which musical tone is sounded only by depressing the pedal 48 without using a stick.

It can be arbitrarily determined how musical tone control is to be carried out in accordance with detection outputs from the sheet switches 61 indicating that the operation is made ON. The following is an example of the musical tone control. When, for example, striking on the pad section pd is detected by the piezosensor 41 and the sheet sensors 31*f*, 31*r* and 37 (see FIG. 1, etc.) in a state that the sheet switch 61A is not ON, it is determined that open hi-hat is currently played, and processing to generate a corresponding musical tone is carried out. When striking to the pad section pd is detected in a state that any one sheet switch 61 is at ON, it is determined that closed hi-hat is currently played, and processing is performed to generate a musical tone of a tone color corresponding to an innermost sheet switch among the sheet switches 61 made ON at that time. If in particular the innermost sheet switch is the sheet switch 61D, the tone color of the musical tone is made similar to that in the case of closed hi-hat in an acoustic HH.

At the time of striking with the pedal, a corresponding musical tone is generated for example when the sheet switch 61D is made ON. The sound volume at that time is set in accordance for example with a time period from when a predetermined sheet switch (a predetermined one of the sheet switches 61A to 61C) is made ON to when the sheet switch 61D is made ON in the forward stroke of the pedal operation.

In a case that a pedal ON/OFF operation is performed during the generation of a sound in response to the striking to the pad section pd, the tone color may be changed realtime in accordance with by which of the sheet switches 61 the ON/OFF operation is detected. When a mute operation is detected by the sheet sensors 31*f*, 31*r*, a musical tone, which is currently sounded in response to the striking with the pedal, is also controlled so as to be attenuated.

In the forward stroke of the pedal operation, the elastic member 63 of the operation detecting unit UNT is deformed by the skirt portions 64A, 64B (see FIG. 9). As a result, a reaction force against the pedal operation (hereinafter referred to as the first reaction force) is generated. Subsequently, when the stopper 69 is made in contact with the base plate 60, the elastic member 63 per se is hard to elastically deform. When the elastic member 63 is made in contact with the bottom seat 80, the elastic member 82 of the bottom seat 80 starts to receive a depression force from the supporting surface 84*a* of the seat support member 84. In a strict sense, the elastic member 82 starts to be slightly elastically deformed. However, since the rigidity of the elastic member 82 is adequately larger than that of the skirt portions 64A, 64B of the elastic member 63, the elastic member 82 is hard to elastically deform until the stopper 69 is in contact with the base plate 60 in the forward stroke of the pedal operation.

When the stopper 69 is in contact with the base plate 60, however, the depression force received by the elastic member 82 from the seat support member 84 abruptly increases, and therefore, the elastic member 82 starts to macroscopically elastically deform. Specifically, after the elastic member 63 is elastically deformed by a predetermined amount, a macroscopic elastic deformation of the elastic member 82 takes place. With the macroscopic elastic deformation of the elastic member 82, a second reaction force is generated with a delay after generation of the first reaction force.

In the case of an acoustic HH cymbal, when a pedal operation is performed, a top cymbal is made in contact with a bottom cymbal and a reaction force is generated. When the pedal is further depressed, the reaction force increases, and each of the cymbals is slightly deformed so as to be turned inside out. A change in reaction force due to the cymbals being turned inside out is pleasant for the player. In addition, the player can stop the pedal depression when perceiving a reaction force of appropriate strength.

The reaction force generated from when the top cymbal is made in contact with the bottom cymbal to when the cymbals start to be deformed so as to be turned inside out corresponds to the above described first reaction force. The reaction force generated after the cymbals start to be deformed so as to be turned inside out corresponds to the above described second reaction force. It is therefore possible to generate a realistic change in reaction force in response to the pedal operation, which is similar to a change in reaction force generated in an acoustic HH. It should be noted that a preferable change in reaction force is a sensual change, and the first and second reaction forces can be set at arbitrary values.

In this embodiment, a range of pivotal angle of the HH pad body PDT is restricted by the engagement between the whirl-stop pin 54 of the supporting unit 50 and the whirl-stop hole 40*c* of the frame 40, and the whirl-stop pin and the whirl-stop hole are formed into shapes by which the restricted range of pivotal angle is made different between in the front-to-rear direction and the left-to-right direction (see FIGS. 3 and 5, etc.). A maximum amount of pivotal motion of the HH pad body PDT is therefore made different depending on the direction, whereby natural and appropriate pivotal motion can be attained. In particular, in this embodiment, the striking area on the pad section pd includes a front side portion and also includes left and right side portions of the pad section, whereby the range of pivotal angle of the HH pad body PDT can be made different between when the front side portion is struck and when the left or right side portion is struck.

The range of rotation angle of the HH pad body PDT is restricted by the engagement between the whirl-stop pin 54 and the whirl-stop hole 40*c*. Thus, the mechanism for restricting the pivotal motion of the HH pad body PDT also achieves a rotation preventing function, whereby the rotation prevention can be realized by a compact construction. The pivotal motion restriction/rotation prevention mechanism comprised of the whirl-stop hole 40*c* formed by a through hole and the whirl-stop pin 54 made of a rod member is simple in construction.

In this embodiment, the rear cover 70 includes three arm portions 71 radially extending from the base portion 73 to the circumference portion pda of the pad section pd (see FIG. 4), whereby a reduction in weight can be achieved, and a natural pivotal motion can be realized by concentrating the weight to the center of the electronic pad. Furthermore, the piezosensor 41 is disposed at a location where there is one of the arm portions 71 (arm portion 71A) of the rear cover 70, and therefore a vibration produced by the striking is appropriately and effectively conveyed to the piezosensor 41.

Furthermore, since the signal output units 32, 33 are disposed at locations where there are the arm portions 71 (arm portions 71B, 71C) of the rear cover 70 as viewed in plan and are covered by the arm portions 71 from below, the signal output units 32, 33 can be protected and the external appearance can be improved. In particular, since the signal output units 32, 33 are disposed at locations where there are arm portions different from each other and also different from the arm portion 71A disposed at a location where there is the piezosensor 41, the weight balance of the entire electronic pad PD can easily be made appropriate. Since the signal line 36 (see FIG. 8B) is hidden by the rear cover 70 from below, the signal line 36 is protected and the external appearance is improved. From the viewpoint of protection and improvement of appearance of the signal output units 32, 33, the two signal output units 32, 33 and the piezosensor 41 may be disposed so as to be hidden by the same arm portion 71.

In this embodiment, the sheet sensor 31*f* is disposed over more than half area on the front side at the circumference portion of the frame 40 of the HH pad body PDT, the sheet sensor 31*r* is disposed in the rear side area, and these sheet sensors independently output detection signals. It is therefore possible to detect the striking and the mute operation to the rear, left, and right circumference portions pda of the pad section pd independently of detection of the striking and the mute operation to the front circumference portion pda of the pad section pd, thereby capable of improving the performance expression.

In this embodiment, the bottom seat 80 is stationary and the HH pad body PDT is moved up and down in response to a pedal operation, which are the same in the form of operation as a bottom cymbal and a top cymbal of an acoustic HH. Thus, an operational appearance at the time of the striking with pedal can be made close to that of an acoustic HH cymbal.

Since the sheet switch 61A is substantially annular in shape (see FIG. 11) and the actuators 68A are is disposed at four places (front, rear, left, and right) circumferentially spaced apart from one another (see FIG. 10A), the sheet switch 61A is positively depressed by any of the actuators 68A, even if the HH pad body PDT is moved downward in an inclined state or even if the elastic member 63 is somewhat deformed, whereby the pedal operation can accurately be detected.

The actuators 68 are provided at two (or four) places most distant from each other on the circumferences of circles corresponding to the sheet switches 61, the operation can be detected with accuracy, even if the HH pad body PDT is moved downward in a state it is inclined in any direction.

From the viewpoint of accurately performing the operation detection even if the HH pad body PDT is moved downward in an inclined state, it is preferable that the actuators 68 should be provided in a circumferential range corresponding to the associated sheet switches 61 as viewed in plan at two or more locations most distant from each other on the circumference within the installation range of the sheet switches 61. The number of the actuators is not limited. The actuators 68 may be configured as a plurality of projecting parts as in the above described example, but may be formed into annular or substantially annular projecting ridges.

The sheet switch 61A is formed into a substantially annular shape, but is not limited thereto. By taking the inclination of the HH pad body PDT and the deformation of the elastic member 63 into consideration, the sheet switch 61A may be enough to be disposed on the installation surface 60*a* of the base plate 60 such that the actuators 68A can be in contact therewith.

In this embodiment, since the up-and-down motion of the HH pad body PDT per se, which operates similarly to a top cymbal of an acoustic HH, is detected, a realistic detection can be carried out, and a relation between pedal performance and generated musical tone is made similar to that in an acoustic HH. A realistic detection of the striking with a stick as in the case of an acoustic HH can be carried out using the piezosensor 41, etc.

In the forward stroke of pedal operation, contact between the actuators 68 and the sheet switches 61 in the operation detecting unit UNT takes place in the order from the radially outwardmost group of the actuator 68 and the sheet switch 61, and detection signals are output in sequence. With such a stepwise detection, a more realistic operation can be detected.

The radially inward sheet switches 61 are intermittently installed in the circumference direction, and the radially more outward sheet switches are installed in broader circumferential installation areas and formed into shapes closer to an annular shape. The operation in the initial stage of contact between the operation detecting unit UNT and the bottom seat 80 can reliably be detected by the radially outward sheet switches 61 installed over broad areas. On the other hand, the radially inward sheet switches 61 for detecting the operation in the later stage of contact in which the inclination of the HH pad body PDT decreases is installed over a minimum area, thereby making it possible to simplify the construction and reduce the cost.

In this embodiment, since the sliding member 83 is affixed to an upper part of the bottom seat 80 with which the elastic member 63 of the operation detecting unit UNT is made in contact, the posture of the HH pad body PDT which is sometimes moved downward in an inclined state can be corrected by smooth sliding contact on the upper surface 80*a* of the sliding member 83, thereby accurately detecting the operation.

In this embodiment, the HH pad body PDT and the bottom seat 80 are configured separately from each other, and the operation detecting unit UNT including the sheet switches 61 for detection of pedal operation is formed into one unit and provided on the HH pad body PDT. Furthermore, the piezosensor 41 and the sheet sensors 31*f*, 31*r* and 37 for detecting the striking with a stick are provided on the HH pad body PDT, together with the signal output unit 32 connected to the signal line 36, the sensor lead portions 31*fa*, 31*ra*, etc., and the signal output unit 33 (FIGS. 4, 6, 8B) connected to the sensor lead portions 46 extending from the sheet switches 61.

With the above construction, the signal output unit 33 and the sensor lead portion 46 associated with signal output at the time of pedal operation, and the signal output unit and wiring associated with signal output at the time of the striking with a stick are aggregated on the HH pad body PDT, whereby the management can easily be made. In a conventional arrangement, two sets of sensors, wiring and signal output units must be disposed at two places, and the resultant construction becomes complicated, the number of component parts increases, and the wirings are liable to catch something. On the other hand, in this embodiment, all of the signal output units and the wiring are provided and aggregated on the HH pad body PDT, whereby the management such as handling the wiring and the output terminals can easily be carried out, while making it possible to realistically detect the striking with stick and the striking with pedal in the HH pad body PDT which operates similarly to a top cymbal of an acoustic HH. Solely from the viewpoint of achieving the effect of easy management, the HH pad body PDT may not be formed into a circular shape as viewed in plan, but may be formed into a fan-shape, for example.

In the embodiment, the first reaction force is generated when the elastic member 63 of the operation detecting unit UNT is elastically deformed by the skirt portions 64A, 64B (see FIG. 9) in the forward stroke of pedal operation, and the second reaction force is generated by the elastic member 82 of the bottom seat 80 that starts to be macroscopically elastically deformed when and after the stopper 69 of the operation detecting unit UNT is in contact with the base plate 60. With the above described two-stage change in reaction force, a change in reaction force similar to that in an acoustic HH takes place in response to the pedal operation, whereby the feeling of pedal operation with less discomfort to the player can be realized. Solely from this viewpoint, the HH pad body PDT may not be formed into a circular shape as viewed in plan.

The stopper 69 is made in contact with the base plate 60 in the same timing in which the actuators 68D and the sheet switches 61D of the group corresponding to the fourth stage (predetermined stage) are made in contact with one another. As a result, the timing in which closed hi-hat is detected by the sheet switches 61D coincides with the timing in which the second reaction force is generated, whereby a more realistic feeling of pedal operation can be realized. From this viewpoint, the contact timing for the stopper 69 and the base plate 60 is not limited to being equal to the contact timing for the group of the actuators 68D and the sheet switches 61D, but may arbitrarily be designed. For example, the contact timing may be equal to that for the group of actuators 68E and sheet switches 61E. The number of the groups is not limited to five. Even in a case that the number of the groups is not equal to five, it is preferable that the contact timing for the stopper 69 and the base plate 60 should be made coincident with the contact timing for the group that precedes the last group by at least one group.

Since the operation detecting unit UNT for generating the first reaction force also has a function of detecting the operation of the HH pad body PDT caused by the pedal operation, the up-and-down motion of the HH pad body PDT can be detected with reality with a compact arrangement.

Since the elastic member 82 for generating the second reaction force is provided at that portion of the bottom seat 80 which is supported by the seat support member 84, the bottom seat 80 can easily be attached to the seat support member 84 by the elasticity of the elastic member 82 when a pedal-off operation is performed, whereby the bottom seat 80 is prevented from being taken away by the HH pad body PDT. Thus, the bottom seat 80 can be supported, for example, simply by being placed, without the need of being fixed to the seat support member 84, resulting in simple construction and handling.

In the embodiment, the supporting unit 50 is integrally formed to include the whirl-stop pin 54 (see FIG. 5), and the HH pad body PDT supported by the supporting unit 50 is able to be pivoted relative to the supporting unit 50, with their relative rotation restricted. In addition, the supporting unit 50 mounted with the HH pad body PDT can be detachably mounted to the movable support rod 47 of a stand by manipulating the knob 49 of the supporting rod fastener 59. Moreover, an upper half of the supporting rod fastener 59 can be fixed with the movable support rod 47 using a simple pressure-contact mechanism. The movable support rod 47 may be a simple rod, and therefore a commercially available stand can be utilized therefor. Thus, the HH pad body PDT can detachably be mounted to a commercially available stand with ease, while ensuring the pivotal motion restriction and whirl-stop function. Since the HH pad body PDT can be handled separately from the supporting unit 50, they can be made less bulky and convenient for sale and transportation.

In the embodiment, the whirl-stop pin 54 (see FIG. 5) may not be projectingly provided at the base portion 51*a*, but may be projectingly provided at any position which is fixed relative to the movable support rod 47.

The operation detecting unit UNT includes the groups of actuators 68 and sheet sensors 61 for detection of an up-and-down motion of the HH pad body PDT. The detection mechanism is not limited thereto, and may be any mechanism for outputting a signal upon being depressed. For example, a contact switch may be used which includes a stationary contact pattern instead of the sheet switches 61 and movable contacts provided at tip ends of actuators 68. From the viewpoint of ensuring the detecting function, a vertical positional relation between the actuators 68 and the sheet switches 61 may be reversed.

From the viewpoint of making the external appearance of action similar to that in an acoustic HH cymbal and detecting the realistic action similar to a top cymbal, the operation detecting unit UNT may be fixedly disposed at a location corresponding to a bottom cymbal. In that case, an element corresponding to the sliding member 83 is disposed to a portion disposed on the HH pad body PDT for contact with the operation detecting unit UNT.

In the embodiment, the first reaction force is generated by the operation detecting unit UNT, and the second reaction force approximated to a reaction force to turn a hi-hat cymbal inside out is generated by the bottom seat 80. From the viewpoint of approximating a change in reaction force at the time of pedal operation to that in an acoustic arrangement, reaction force generating mechanisms may be provided at any places. These mechanisms may be disposed on one or both of the HH pad body PDT side and the bottom seat 80 side. A vertical positional relation between the mechanisms is not limited. The number of the mechanisms may be three or more so as to change the reaction force in three or more stages. As far as the reaction force generation is concerned, the elastic member 82 of the bottom seat 80 may not be provided below the bottom seat 80 but may be provided thereabove for contact with the operation detecting unit UNT.

What is claimed is:

1. A hi-hat type electronic pad comprising:

a movable pad body formed into a circular shape as viewed in plan and adapted to be supported by a support member so as to be pivoted when it is struck and adapted to be vertically moved in unison with the support member vertically moved by a pedal operation;

a bottom section configured separately from said movable pad body and disposed beneath said movable pad body, said bottom section having a fixed vertical position; and an operation detecting unit disposed at that part of one of said movable pad body and said bottom section which faces another of said movable pad body and said bottom section, wherein when said movable pad body is moved downward, said operation detecting unit is adapted to be in contact with said another of said movable pad body and said bottom section, said operation detecting unit includes a plurality of actuators and a plurality of operation sensors, said plurality of actuators being disposed to project from a base corresponding to the part of said one of said movable pad body and said bottom section facing said another of said movable pad body and said bottom section in a direction vertically away from said another of said movable pad body and said bottom section, said plurality of operation sensors being planarity disposed on a sensor installation surface facing the plurality of actuators, said base being adapted to be movable toward and away from the sensor installation surface, each of said plurality of operation sensors is adapted to output a detection signal when depressed by one of said plurality of actuators due to said operation detecting unit being in contact with said another of said movable pad body and said bottom section, and one or more of said plurality of operation sensors are formed into a substantially annular shape as viewed in plan, wherein said plurality of operation sensors are provided coaxially at different radial positions, and said plurality of actuators are provided to correspond to respective ones of said plurality of operation sensors, said plurality of operation sensors cooperating with said plurality of actuators to make up a plurality of groups each including at least one of said plurality of operation sensors and a corresponding at least one of said plurality of actuators, a distance between an operation sensor and an actuator is smaller in a radially more outward group when said operation detecting unit is not in contact with said another of said movable pad body and said bottom section, and detection signals are output from the plurality of operation sensors in an order from an operation sensor of a radially outwardmost group to an operation sensor of a radially inwardmost group when said operation detecting unit is in contact with said another of said movable pad body and said bottom section.

2. The hi-hat type electronic pad according to claim 1, wherein the operation sensors of at least radially inwardmost groups are intermittently installed in a circumferential direction, and the operation sensor in the radially more outward group is installed in a broader circumferential installation range and formed into a shape closer to an annular shape.

3. A hi-hat type electronic pad comprising:

a movable pad body formed into a circular shape as viewed in plan and adapted to be supported by a support member so as to be pivoted when it is struck and adapted to be vertically moved in unison with the support member vertically moved by a pedal operation;

a bottom section configured separately from said movable pad body and disposed beneath said movable pad body, said bottom section having a fixed vertical position; and an operation detecting unit disposed at that part of one of said movable pad body and said bottom section which faces another of said movable pad body and said bottom section, wherein said operation detecting unit comprises a plurality of actuators and a plurality of sensors, wherein when said movable pad body is moved downward, said operation detecting unit is adapted to be depressed onto a flat contact surface of said another of said movable pad body and said bottom section and output a detection signal, the contact surface of said another of said movable pad body and said bottom section is formed by a sliding member on which said operation detecting unit is smoothly slid, and wherein said plurality of operation sensors are provided coaxially at different radial positions, and said plurality of actuators are provided to correspond to respective ones of said plurality of operation sensors, said plurality of operation sensors cooperating with said plurality of actuators to make up a plurality of groups each including at least one of said plurality of operation sensors and a corresponding at least one of said plurality of actuators, a distance between an operation sensor and an actuator is smaller in a radially more outward group when said operation detecting unit is not in contact with said another of said movable pad body and said bottom section, and detection signals are output from the plurality of operation sensors in an order from an operation sensor of a radially outwardmost group to an operation sensor of a radially inwardmost group when said operation detecting unit is in contact with said another of said movable pad body and said bottom section.

4. A hi-hat type electronic pad having a movable pad body formed into a circular shape as viewed in plan and adapted to be supported by a support member so as to be pivoted when it is struck and to be vertically moved in unison with the support member vertically moved by a pedal operation, a bottom section configured separately from the movable pad body and disposed beneath the movable pad body, the bottom section having a fixed vertical position, the movable pad body being adapted to be in contact with the bottom section in a forward stroke of the pedal operation in which the movable pad body is moved downward, said hi-hat type electronic pad comprising:

an operation detecting unit comprising a plurality of actuators and a plurality of operation sensors;

a first elastic member provided in either one of the movable pad body and the bottom section and adapted to be elastically deformed when the movable pad body is in contact with the bottom section in the forward stroke of the pedal operation; and a second elastic member disposed in another of the movable pad body and the bottom section and having rigidity higher than that of said first elastic member, said second elastic member being adapted to be macroscopically elastically deformed after said first elastic member is elastically deformed by a predetermined amount in the forward stroke of the pedal operation, wherein a reaction force, including a first reaction force generated by elastic deformation of said first elastic member and a second reaction force generated by elastic deformation of said second elastic member, is generated in at least two stages in the forward stroke of the pedal operation, and wherein said plurality of operation sensors are provided coaxially at different radial positions, and said plurality of actuators are provided to correspond to respective ones of said plurality of operation sensors, said plurality of operation sensors cooperating with said plurality of actuators to make up a plurality of groups each including at least one of said plurality of operation sensors and a corresponding at least one of said plurality of actuators, a distance between an operation sensor and an actuator is smaller in a radially more outward group when said operation detecting unit is not in contact with said another of said movable pad body and said bottom section, and detection signals are output from the plurality of operation sensors in an order from an operation sensor of a radially outwardmost group to an operation sensor of a radially inwardmost group when said operation detecting unit is in contact with said another of said movable pad body and said bottom section.

5. The hi-hat type electronic pad according to claim 4, wherein said first elastic member is disposed in that part of one of the movable pad body and the bottom section facing another of the movable pad body and the bottom section, and a detection signal is output when said first elastic member is depressed by said another of the movable pad body and the bottom section in the forward stroke of the pedal operation.

6. The hi-hat type electronic pad according to claim 5, wherein an operation of the movable pad body is detected in plural stages in the forward stroke of the pedal operation and an operation up to a predetermined stage is detected when said first elastic member is elastically deformed by the predetermined amount.

7. The hi-hat type electronic pad according to claim 4, wherein said second elastic member is provided in that part of a lower portion of the bottom section which is supported by a fixed part which is fixed relative to an installation surface.

8. A hi-hat type electronic pad having a movable pad body formed into a circular shape as viewed in plan and adapted to be supported by a support member so as to be pivoted when it is struck and to adapted to be vertically moved in unison with the support member vertically moved by a pedal operation, and a bottom section configured separately from the movable pad body and disposed beneath the movable pad body, the bottom section having a fixed vertical position, said hi-hat type electronic pad comprising:

a striking detection unit disposed on the movable pad body and adapted to output a detection signal when detecting that the movable pad body is struck;

an operation detecting unit disposed in that part of the movable pad body facing the bottom section and adapted to output a detection signal when depressed by the bottom section as the movable pad body is moved downward; and an external output unit disposed on the movable pad body and adapted to output one or more detection signals of said striking detection unit and the detection signal of said operation detecting unit to outside, wherein said operation detecting unit comprises a plurality of actuators and a plurality of sensors, and wherein said plurality of operation sensors are provided coaxially at different radial positions, and said plurality of actuators are provided to correspond to respective ones of said plurality of operation sensors, said plurality of operation sensors cooperating with said plurality of actuators to make up a plurality of groups each including at least one of said plurality of operation sensors and a corresponding at least one of said plurality of actuators, a distance between an operation sensor and an actuator is smaller in a radially more outward group when said operation detecting unit is not in contact with said another of said movable pad body and said bottom section, and detection signals are output from the plurality of operation sensors in an order from an operation sensor of a radially outwardmost group to an operation sensor of a radially inwardmost group when said operation detecting unit is in contact with said another of said movable pad body and said bottom section.

* * * * *